US007202850B2

(12) United States Patent
Kitagawa

(10) Patent No.: US 7,202,850 B2
(45) Date of Patent: Apr. 10, 2007

(54) IMAGE DISPLAY CONTROL APPARATUS AND IMAGE DISPLAY CONTROL METHOD

(75) Inventor: Daisaku Kitagawa, Neyagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 408 days.

(21) Appl. No.: 10/720,082

(22) Filed: Nov. 25, 2003

(65) Prior Publication Data

US 2004/0104877 A1 Jun. 3, 2004

(30) Foreign Application Priority Data

Nov. 26, 2002 (JP) ..... 2002-342839

(51) Int. Cl.
*G09G 3/36* (2006.01)

(52) U.S. Cl. ..... 345/102; 345/214

(58) Field of Classification Search ..... 345/102, 345/87, 204, 214; 349/61
See application file for complete search history.

(56) References Cited

U.S. PATENT DOCUMENTS

2003/0001815 A1* 1/2003 Cui ..... 345/102
2003/0197674 A1* 10/2003 Herrmann ..... 345/102

FOREIGN PATENT DOCUMENTS

JP 11-65531 3/1999

* cited by examiner

*Primary Examiner*—Amr A. Awad
*Assistant Examiner*—Stephen G Sherman
(74) *Attorney, Agent, or Firm*—Wenderoth, Lind & Ponack, L.L.P.

(57) ABSTRACT

An image display control apparatus having a small-size circuit includes: an image state detection unit for detecting a state of an image based on an image signal using a resource subunit in a resource unit; an image signal transformation unit for transforming the image signal, using the resource subunit in the resource unit, based on the state of the image detected by the image state detection unit; and a resource control unit for assigning the resource subunit in the resource unit to each of the image state detection unit and the image signal transformation unit according to a count number of cycles of an operation clock outputted from a clock unit.

13 Claims, 17 Drawing Sheets

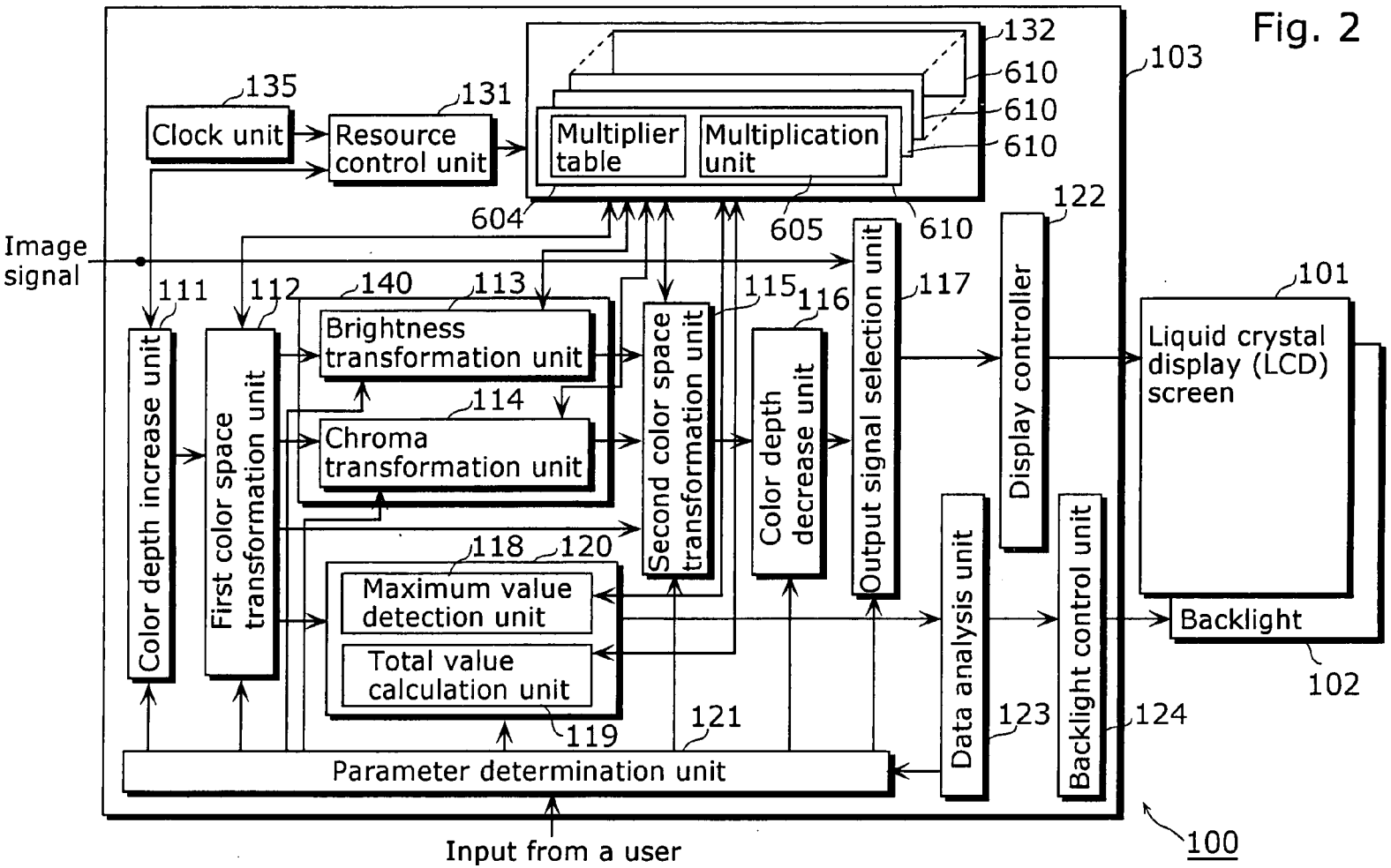
Fig. 2
100
101
Liquid crystal display (LCD) screen
102
Backlight
103
Backlight control unit
124
Display controller
122
Data analysis unit
123
Output signal selection unit
117
Color depth decrease unit
116
Second color space transformation unit
115
Parameter determination unit
121
Input from a user
Maximum value detection unit
120
Total value calculation unit
119
Brightness transformation unit
113
Chroma transformation unit
114
First color space transformation unit
112
Color depth increase unit
111
Image signal
Multiplication unit
605
Multiplier table
604
610
610
610
610
132
Resource control unit
131
Clock unit
135
140

IMAGE DISPLAY CONTROL APPARATUS AND IMAGE DISPLAY CONTROL METHOD

BACKGROUND OF THE INVENTION (1) Field of the Invention

The present invention relates to an image display control apparatus or the like that controls light transmittance of liquid crystals of a liquid crystal display (LCD) screen for displaying images based on an inputted image signal and controls, according to the light transmittance of the liquid crystals, an amount of light emitted by a backlight for illuminating the back of the LCD screen based on the image signal.

(2) Description of the Related Art

In recent years, apparatuses for controlling LCD screens have been widely used as image display apparatuses for mobile information terminals such as notebook computers. This type of an image display apparatus controls light transmittance of liquid crystals of an LCD screen on a pixel-by-pixel basis based on image data and displays images on the LCD screen by illuminating the back of the LCD screen using a backlight.

LCD screens are thin and compact, and thus heavily used for mobile information terminals such as notebook computers. However, to take a notebook computer as an example, power consumption of a backlight is about 5W, which accounts for about a quarter to a half of the entire power consumption of the computer. Since such a mobile information terminal is structured so as to operate by batteries or the like, how to reduce power consumption is a big problem.

A conventional image display apparatus will be explained with reference to the drawings.

FIG. 1 is a block diagram showing a structure of a conventional image display apparatus.

The image display apparatus includes an LCD screen 920 and an image display control apparatus 900 for controlling an amount of light emitted by a backlight 921. In the image display control apparatus 900, a data analysis unit 901 obtains, based on image data inputted from an image memory 910, an acceptable limit within which brightness of an image can be increased, a data control unit 902 controls the brightness of the image data based on the obtained limit, and an image controller 903 generates a driving signal based on the controlled image data to have the LCD screen 920 display the image. A dimmer 904 controls an amount of light emitted by the backlight 921 according to the limit obtained by the data analysis unit 901.

As a result, in order to reduce the power consumption, the image display control apparatus 900 controls the image data so as to increase the light transmittance of the LCD screen 920 as much as possible and instead lower the amount of light emitted by the backlight 921 accordingly to the increase of the light transmittance, and thus displays the image of the same quality as that displayed without controlling the image data nor the light amount emitted by the backlight (See Japanese Laid-Open Patent Application No. H11-65531).

However, in the image display control apparatus 900 of the above-mentioned conventional image display apparatus, the data analysis unit 901, the data control unit 902 and others use a lot of resources such as multiplication units, so the circuit in the image display control apparatus becomes large in size. As a result, the conventional image display apparatus has a problem that a mobile information terminal such as a notebook computer becomes large in size when such an image display control apparatus is integrated into the mobile information terminal.

SUMMARY OF THE INVENTION

The present invention has been conceived in view of the above problems, and aims at providing an image display control apparatus and an image display apparatus of which circuits are small in size.

In order to achieve the above object, the image display control apparatus according to the present invention is an image display control apparatus that controls light transmittance of liquid crystals of a liquid crystal display screen for displaying an image based on an inputted image signal and controls, according to the light transmittance of the liquid crystals, an amount of light emitted by a backlight unit for illuminating a back of the liquid crystal display screen based on the image signal, the image display control apparatus comprising: an image state detection unit operable to detect a state of the image based on the image signal; an image signal transformation unit operable to transform the image signal by performing predetermined signal processing on said image signal based on the state of the image detected by the image state detection unit, and control the light transmittance of the liquid crystals based on the transformed image signal; and a resource control unit operable to assign an arithmetic operation resource for performing an arithmetic operation exclusively to the image state detection unit and the image signal transformation unit respectively at predetermined timings, wherein the image state detection unit detects the state of the image using the assigned arithmetic operation resource, and the image signal transformation unit transforms the image signal using the assigned arithmetic operation resource.

Accordingly, the resource control unit assigns an arithmetic operation resource exclusively to the image state detection unit and the image signal conversion unit at predetermined timings, the image state detection unit detects the state of the image using the assigned arithmetic operation resource, and the image signal transformation unit transforms the image signal using the assigned arithmetic operation resource. Therefore, the image state detection unit and the image signal transformation unit can share the use of the arithmetic operation resource, and thus the arithmetic operation resources do not need to be provided separately for the image state detection unit and the image signal transformation unit. As a result, the arithmetic operation resources of the image display control apparatus can be significantly reduced, and thus the circuit size of the image display control apparatus can also be decreased.

The above-mentioned image display control apparatus may further comprise a color space transformation unit operable to transform a color component signal consisting of R, G and B component signals in the image signal into a color information signal including at least a brightness signal and a chroma signal, and output said color information signal to the image signal transformation unit, wherein the resource control unit assigns the arithmetic operation resource exclusively to the color space transformation unit at a predetermined timing, and the color space transformation unit transforms the color component signal into the color information signal using the assigned arithmetic operation resource.

Accordingly, the color space transformation unit in addition to the image state detection unit and the image signal transformation unit share the use of the above-mentioned arithmetic operation resource. Therefore, the arithmetic operation resource of the image display control apparatus can be substantially reduced, and thus the circuit size of the image display control apparatus can also be decreased.

The above-mentioned image display control apparatus may further comprise a second color space transformation unit operable to transform the color information signal including at least the brightness signal and the chroma signal into the color component signal consisting of the R, G and B component signals and output said transformed color component signal, said color information signal being the image signal transformed by the image signal transformation unit, wherein the resource control unit assigns the arithmetic operation resource exclusively to the second color space transformation unit at a predetermined timing, and the second color space transformation unit transforms the color information signal into the color component signal using the assigned arithmetic operation resource.

Accordingly, the second color space transformation unit in addition to the image state detection unit, the image signal transformation unit and the color space transformation unit share the use of the above-mentioned arithmetic operation resource. Therefore, the arithmetic operation resource of the image display control apparatus can be substantially reduced, and thus the circuit size of the image display control apparatus can also be decreased.

The above-mentioned image display control apparatus may further comprise a clock signal generation unit operable to generate a clock signal, wherein the resource control unit counts cycles of the clock signal generated by the clock signal generation unit and assigns the arithmetic operation resource according to a count number.

Accordingly, the resource control unit can assign the arithmetic operation resource at a predetermined timing.

Furthermore, each of the image state detection unit, the image signal transformation unit, the color space transformation unit and the second color space transformation unit may perform predetermined processing on each pixel in the image signal, and a time interval between inputs of said each pixel in the image signal may be longer than the cycle of the clock signal generated by the clock signal generation unit.

Accordingly, the resource control unit can assign the arithmetic operation resource to the image state detection unit, the image signal transformation unit, the color space transformation unit and the second color space transformation unit so that these units can perform their own processing according to the count numbers of the cycles of the clock signal.

In addition, an image display control method according to the present invention is an image display control method executed by an image display control apparatus that controls light transmittance of liquid crystals of a liquid crystal display screen for displaying an image based on an inputted image signal and controls, according to the light transmittance of the liquid crystals, an amount of light emitted by a backlight unit for illuminating a back of the liquid crystal display screen based on the image signal, the image display control method comprising: an image state detection step of detecting a state of the image based on the image signal; an image signal transformation step of transforming the image signal by performing predetermined signal processing on said image signal based on the state of the image detected in the image state detection step, and controlling the light transmittance of the liquid crystals based on the transformed image signal; and a resource control step of assigning an arithmetic operation resource for performing an arithmetic operation exclusively to an image state detection unit operable to execute the image state detection step and an image signal transformation unit operable to execute the image signal transformation step respectively at predetermined timings, wherein in the image state detection step, the image state detection unit detects the state of the image using the assigned arithmetic operation resource, and in the image signal transformation step, the image signal transformation unit transforms the image signal using the assigned arithmetic operation resource.

The present invention can also be realized as a program for causing a computer to execute all the steps included in the above-mentioned image display control method, as a storage medium for storing the program, and as an image display apparatus including the above image display control apparatus and the liquid crystal display screen.

If the present invention is realized as an image display apparatus, it brings about an effect of miniaturizing the entire image display apparatus.

As further information about technical background to this application, Japanese Patent Application No. 2002-342839 filed on Nov. 26, 2002 is incorporated herein by reference.

BRIEF DESCRIPTION OF THE DRAWINGS

These and other objects, advantages and features of the invention will become apparent from the following description thereof taken in conjunction with the accompanying drawings that illustrate a specific embodiment of the invention. In the Drawings:

FIG. 2 is a block diagram showing a structure of an image display apparatus in an embodiment of the present invention;

DESCRIPTION OF THE PREFERRED EMBODIMENT(S)

Figure 1:
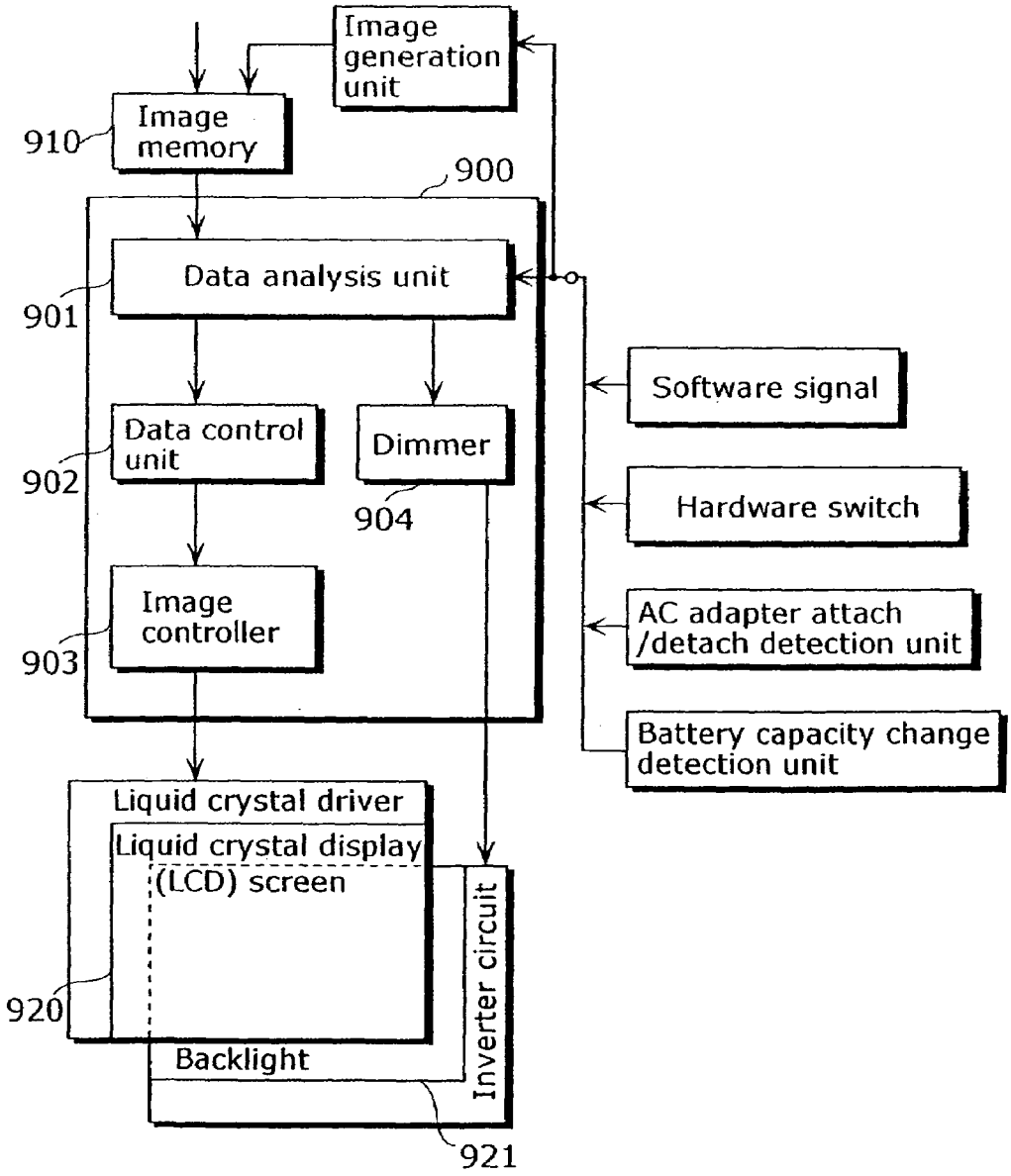
PRIOR ART Fig. 1
FIG. 1 is a block diagram showing a structure of a conventional image display apparatus.

The embodiment of the present invention will be explained below with reference to the drawings.

FIG. 2 is a block diagram showing a structure of an image display apparatus of the present invention.

An image display apparatus 100 is to be incorporated in a mobile information terminal such as a mobile phone and a notebook computer, and includes a LCD screen 101 for displaying images according to light transmittance of liquid crystals; a backlight 102 for illuminating the back of the LCD screen 101; and an image display control unit 103 for controlling the light transmittance of the liquid crystals of the LCD screen 101 based on an inputted image signal and controlling an amount of light emitted by the backlight 102 according to the light transmittance of the liquid crystals.

This image display control unit 103 includes: a color depth increase unit 111; a first color space transformation unit 112; an image signal transformation unit 140 including a brightness transformation unit 113 and a chroma transformation unit 114; a second color space transformation unit 115; a color depth decrease unit 116; an output signal selection unit 117; an image state detection unit 120 including a maximum value detection unit 118 and a total value calculation unit 119; a parameter determination unit 121; a display controller 122; a data analysis unit 123; a backlight control unit 124; a resource control unit 131; a clock unit 135; a resource unit 132 including a plurality of resource subunits 610 consisting of multiplier tables 604 and multiplication units 605; and others.

In this image display control unit 103, the image state detection unit 120 detects a state of an image on a basis of every still image (hereinafter referred to as a frame) based on an image signal obtained via the color depth increase unit 111 and the first color space transformation unit 112, and the image signal transformation unit 140 transforms the brightness signal and the chroma signal of the image depending on the image state. As a result, the image display control unit 103 outputs a control signal for controlling the light transmittance of the liquid crystals of the LCD screen 101 and outputs a control signal for controlling the amount of light emitted by the backlight 102 depending on the above image state.

The resource control unit 131 counts the cycle of the operation clock (clock signal) oscillated by the clock unit 135 at a regular interval, and assigns arithmetic operation resources such as the multiplier table 604 and the multiplication unit 605 in the resource unit 132 to respective units in the image display control unit 103 such as the brightness transformation unit 113 and the chroma transformation unit 114. In other words, respective units in the image display control unit 103 share the use of the arithmetic operation resources in the resource unit 132. Also, these units in the image display control unit 103 operate based on the operation clock oscillated by the clock unit 135.

Here, an image signal inputted to the image display control unit 103 will be explained with reference to FIG. 3.

Figure 3:
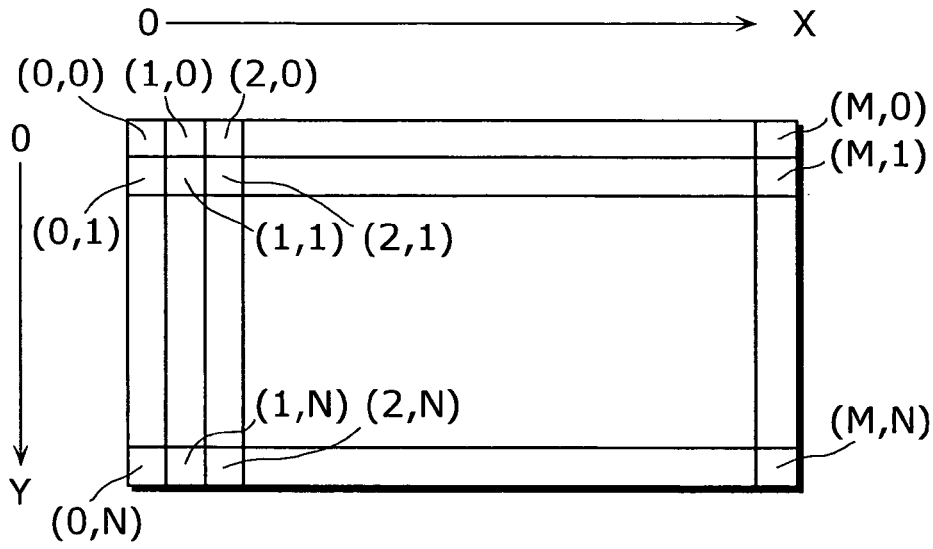
FIG. 3 is an illustration explaining an image signal in the present embodiment.

FIG. 3 is an illustration of an image signal for one frame in the image signal inputted to the image display control unit 103.

As shown in FIG. 3, an image signal for one frame is divided in both vertical and horizontal directions respectively, and a minimum element of a divided rectangle is called a pixel. Each pixel has one attribute represented uniquely by color components, namely, an R component, a G component and a B component.

Assuming that the horizontal and vertical directions in the image signal for one frame is an X axis and a Y axis and the coordinate of the upper left corner of the frame is (0, 0) as shown in FIG. 3, the position of each pixel is expressed by (x, y). In FIG. 3, the image signal for one frame is divided into (M+1) pixels (where M+1 is a positive integer of 2 or larger) in the horizontal direction and divided into (N+1) pixels (where N+1 is a positive integer of 2 or larger) in the vertical direction.

This image signal for one frame is inputted to the image display control unit 103 for processing in order of pixel coordinates from left to right and from top to down, namely, first the coordinates on the top line in the horizontal direction (0, 0), (1, 0), (2, 0), . . . , (M, 0), then the coordinates on the second line (0, 1), (1, 1), (2, 1), . . . , (M, 1), and lastly the coordinates on the bottom line (0, N), (1, N), (2, N), . . . , (M, N).

As mentioned above, in the image signal for one frame out of the image signal inputted to the image display control unit 103, respective pixels representing their own attributes are arranged serially in the above-mentioned order of processing.

Next, each unit of the image display control unit 103 will be explained in detail.

Figure 4:
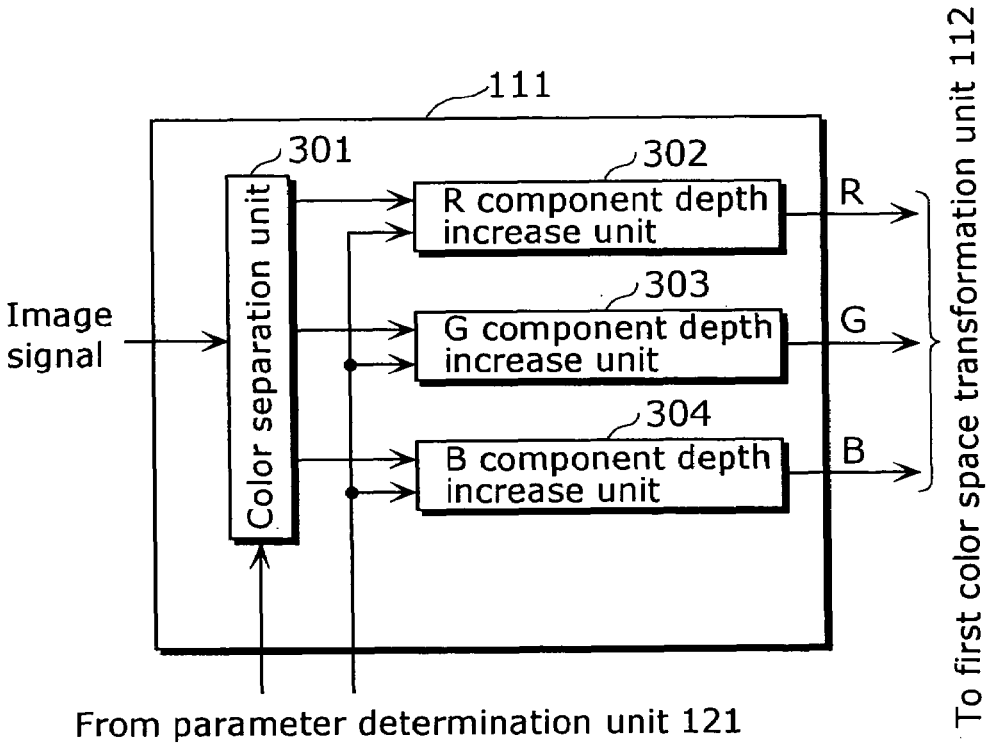
FIG. 4 is a block diagram showing a structure of a color depth increase unit in the present embodiment.

FIG. 4 is a block diagram showing a structure of the color depth increase unit 111. The color depth increase unit 111, including a color separation unit 301, an R component depth increase unit 302, a G component depth increase unit 303 and a B component depth increase unit 304, separates an inputted image signal into color component signals, namely, an R component signal, a G component signal and a B component signal for each pixel, and changes the tone of each color component signal and outputs it.

The color separation unit 301 separates the inputted image signal into color component signals R, G and B which are represented by 5 or 6 bits respectively according to the parameter values determined by the parameter determination unit 121 as shown in FIG. 2.

The parameter determination unit 121 determines these parameter values based on a user's entry accepted via an operating unit not shown here, or by calculation depending on the image state of each frame.

Here, according to the user's instruction by his entry, the color separation unit 301 separates the image signal into respective component signals represented by 5 or 6 bits.

Figure 5A:
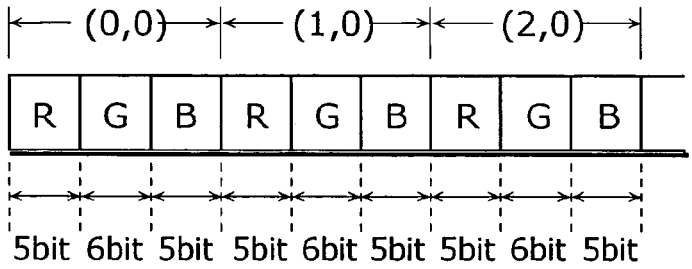
FIG. 5A is an illustration explaining color component signals of each pixel inputted to the image display apparatus in the present embodiment.

FIG. 5A is a diagram showing an image signal of each pixel before change of a tone of each color component signal. As shown in FIG. 5A, each of the pixels on the coordinates (0, 0), (1, 0) and (2, 0) is represented by 5 bits of depth of the R component signal, 6 bits of depth of the G component signal and 5 bits of depth of the B component signal. Each pixel is represented by bits in a format corresponding to the image display on the LCD screen 101.

The R component depth increase unit 302, the G component depth increase unit 303 and the B component depth increase unit 304 change, based on the parameter values determined by the parameter determination unit 121, the formats of the color component signals obtained by the above separation so that the tones of these component signals become higher.

Figure 5B:
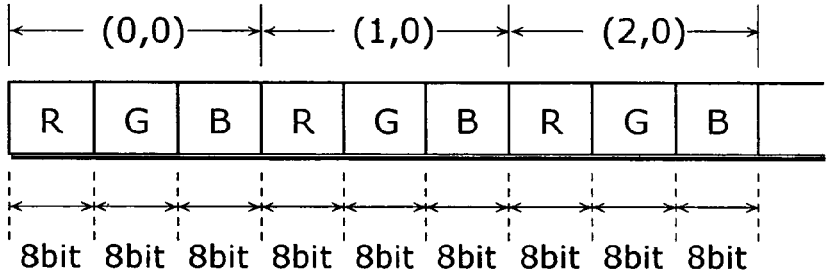
FIG. 5B is an illustration explaining color component signals of each pixel obtained after the tone is changed.

FIG. 5B is a diagram showing an example of an image signal of each pixel after change of a tone of each color component signal. As shown in FIG. 5B, each of the pixels on the coordinates (0, 0), (1, 0) and (2, 0) is represented by 8 bits of depth of the R, G and B component signals.

As an example of changing the color tone, the following is an explanation of a state in which the R component depth increase unit 302 changes a component signal of its color tone of 6 bits into a component signal of its color tone of 8 bits.

Figure 6:
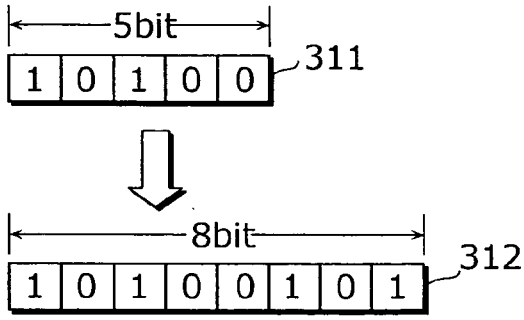
FIG. 6 is an illustration explaining change of a color tone by the color depth increase unit in the present embodiment.

FIG. 6 is a schematic diagram showing an example of a change of a color component tone.

As shown in FIG. 6, a component signal 311 is a signal of a 5-bit color tone inputted to the R component depth increase unit 302, whereas a component signal 312 is a signal of a 8-bit color tone outputted from the R component depth increase unit 302.

In this case, the R component depth increase unit 302 adds the higher-order 3 bits of the component signal 311 of the 5-bit color tone to the lower-order of the component signal 311 itself so as to change it into the component signal 312 of the 8-bit color tone.

Here, according to the user's instruction by his entry to the parameter determination unit 121, the R component depth increase unit 302, the G component depth increase unit 303 and the B component depth increase unit 304 change the color tones of respective color component signals from 5 or 6 bits to 8 bits.

As mentioned above, change of color tones by the color depth increase unit 111 allows high accuracy of the subsequent processing, and thus final output of a high-grade image signal.

Figure 7:
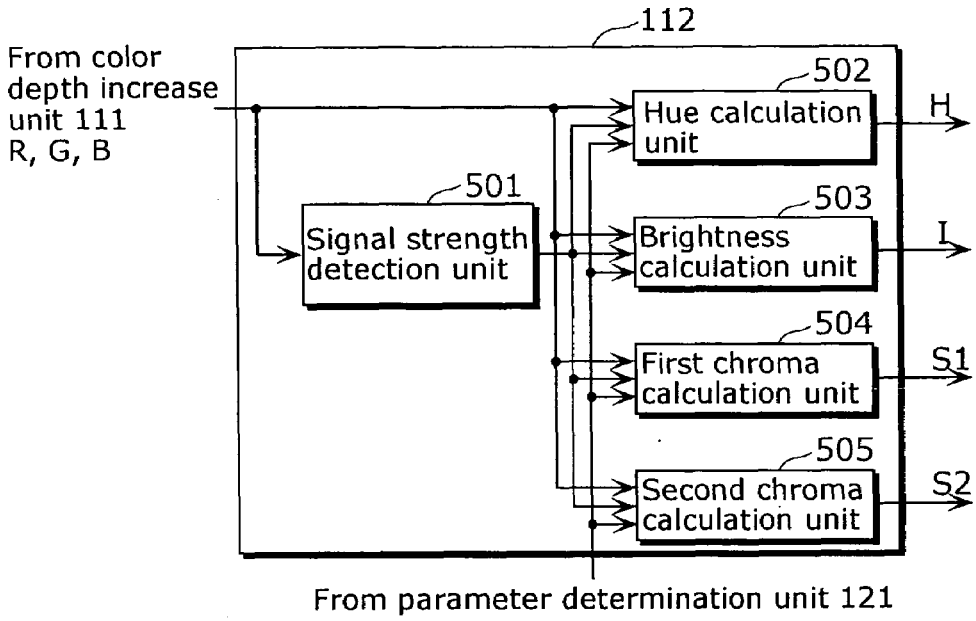
FIG. 7 is a block diagram showing a structure of a first color space transformation unit in the present embodiment.

FIG. 7 is a block diagram showing a structure of the first color space transformation unit 112.

The first color space transformation unit 112 includes a signal strength detection unit 501, a hue calculation unit 502, a brightness calculation unit 503, a first chroma calculation unit 504 and a second chroma calculation unit 505, and transforms component signals R, G and B outputted from the color depth increase unit 111 into an information signal having color information such as hue, brightness and chroma.

The signal strength detection unit 501 detects the signal strength of the component signals R, G and B in each pixel outputted from the color depth increase unit 111, namely, which is the maximum value, the intermediate value or the minimum value among the component signals. If the signal strength detection unit 501 detects that the component signal R is the maximum value, for example, it means that the pixel is reddish.

The hue calculation unit 502 calculates a hue signal H that is a color information signal based on the values of the component signals R, G and B outputted from the color depth increase unit 111, the signal strengths detected by the signal strength detection unit 501 and the parameter values determined by the parameter determination unit 121, and outputs the hue signal H to the second color space transformation unit 115.

The brightness calculation unit 503 calculates a brightness signal I that is a color information signal based on the values of the component signals R, G and B outputted from the color depth increase unit 111, the signal strengths detected by the signal strength detection unit 501 and the parameter values determined by the parameter determination unit 121, and outputs the brightness signal I to the brightness transformation unit 113 and the maximum value detection unit 118 and the total value calculation unit 119 in the image state detection unit 120.

The first chroma calculation unit 504 calculates a chroma signal S1 that is a color information signal based on the values of the component signals R, G and B outputted from the color depth increase unit 111, the signal strengths detected by the signal strength detection unit 501 and the parameter values determined by the parameter determination unit 121, and outputs the chroma signal S1 to the chroma transformation unit 114 and the total value calculation unit 119 in the image state detection unit 120.

The second chroma calculation unit 504 calculates a chroma signal S2 that is a color information signal based on the values of the component signals R, G and B outputted from the color depth increase unit 111, the signal strengths detected by the signal strength detection unit 501 and the parameter values determined by the parameter determination unit 121, and outputs the chroma signal S2 to the second color space transformation unit 105.

Figure 8:
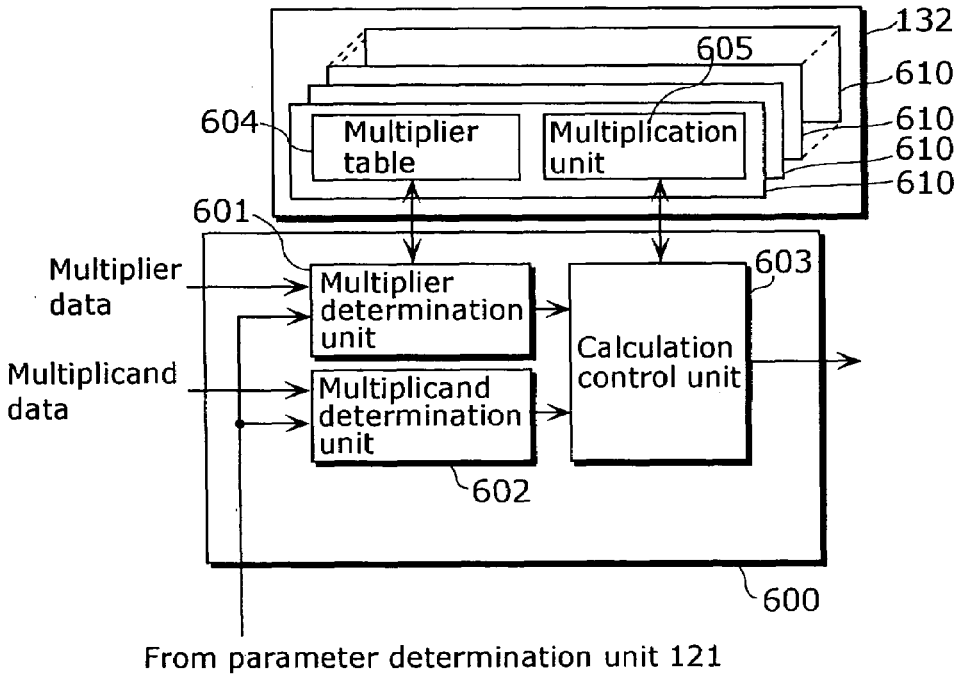
FIG. 8 is a block diagram showing a structure of a calculation unit and a resource unit used for respective units in the image display apparatus in the present embodiment.

FIG. 8 is a block diagram showing an internal structure of each of the hue calculation unit 502, the brightness calculation unit 503, the first chroma calculation unit 504 and the second chroma calculation unit 505.

Each of the hue calculation unit 502, the brightness calculation unit 503, the first chroma calculation unit 504 and the second chroma calculation unit 505 has a calculation unit 600, as shown in FIG. 8. This calculation unit 600 includes a multiplier determination unit 601, a multiplicand determination unit 602 and a calculation control unit 603, performs processing for multiplication based on the obtained multiplier data and multiplicand data and the parameter values determined by the parameter determination unit 121, and outputs the multiplication result to outside.

On the other hand, the resource unit 132 includes a plurality of resource subunits 610 consisting of multiplier tables 604 in a memory table style and multiplication units 605 for performing multiplication. These resource subunits 610 are used for calculation by the calculation unit 600.

The multiplier determination unit 601 obtains the multiplier data and the parameter values determined by the parameter determination unit 121, and determines multipliers with reference to the multiplier table 604 on which the multiplier data and the parameter values are stored as arguments. The multiplicand determination unit 602 obtains the multiplicand data and the parameter values determined by the parameter determination unit 121, and determines multiplicands based on the multiplicand data and the parameter values.

The calculation control unit 603 outputs the multipliers determined by the multiplier determination unit 601 and the multiplicands determined by the multiplicand determination unit 602 to the multiplication unit 605, obtains the results of multiplication performed by the multiplication unit 605 using the multipliers and the multiplicands, and outputs them to outside.

The multiplier data inputted to the multiplier determination unit 601 from the hue calculation unit 502, the brightness calculation unit 503, the first chroma calculation unit 504 and the second chroma calculation unit 505 are the values obtained based on the component signals R, G and B outputted from the color depth increase unit 111, and the multiplicand data inputted to the multiplicand determination unit 602 are the values obtained based on the signal strengths detected by the signal strength detection unit 501.

The parameter values determined by the parameter determination unit 121 and outputted to the hue calculation unit 502, the brightness calculation unit 503, the first chroma calculation unit 504 and the second chroma calculation unit 505 vary by each unit. These parameter values also vary according to an image signal for one frame inputted to the image display control unit 103.

The calculation results outputted from the calculation control unit 603 of the calculation unit 600 in each of the hue calculation unit 502, the brightness calculation unit 503, the first chroma calculation unit 504 and the second chroma calculation unit 505 are the hue signal H, the brightness signal I, the chroma signal S1 and the chroma signal S2.

The resource unit 132 includes a plurality of resource subunits 610, each of which consists of the above multiplier table 604 and the multiplication unit 605, and respective units in the image display control unit 103 can share the use of the resource subunits 610. The resource control unit 131 assigns one or more resource subunits 610 to the first color space transformation unit 112 at a predetermined timing to be mentioned later. As a result, the hue calculation unit 502, the brightness calculation unit 503, the first chroma calculation unit 504 and the second chroma calculation unit 505 in the first color space transformation unit 112 can share the use of the multiplier tables 604 and the multiplication units 605 at that timing. The number of resource subunits 610 assigned to respective units by the resource control unit 131 varies according to the processing performed respectively by those units.

To be more specific, the first color space transformation unit 112 in the present embodiment causes the resource subunit 610 in the resource unit 132 to perform the multiplication as shown in following Equation (1) so as to transform the component signals R, G and B into a hue signal H, a brightness signal I, a chroma signal S1 and a chroma signal S2, as a whole. Note that Sc as shown in Equation (1) is a value determined based on the component signals R, G and B and the parameter values with reference to the multiplication table 604.

$$\begin{pmatrix} H \\ I \\ S1 \\ S2 \end{pmatrix} = \begin{pmatrix} a11 & a12 & a13 & a14 \\ a21 & a22 & a23 & a24 \\ a31 & a32 & a33 & a34 \\ a41 & a42 & a43 & a44 \end{pmatrix} \begin{pmatrix} R \\ G \\ B \\ Sc \end{pmatrix} \quad (1)$$

Next, the image state detection unit 120 for detecting the image state of each frame in the image signal inputted to the image display control unit 103 will be explained. The image state detection unit 120 includes the maximum value detection unit 118 and the total value calculation unit 119.

Figure 9:
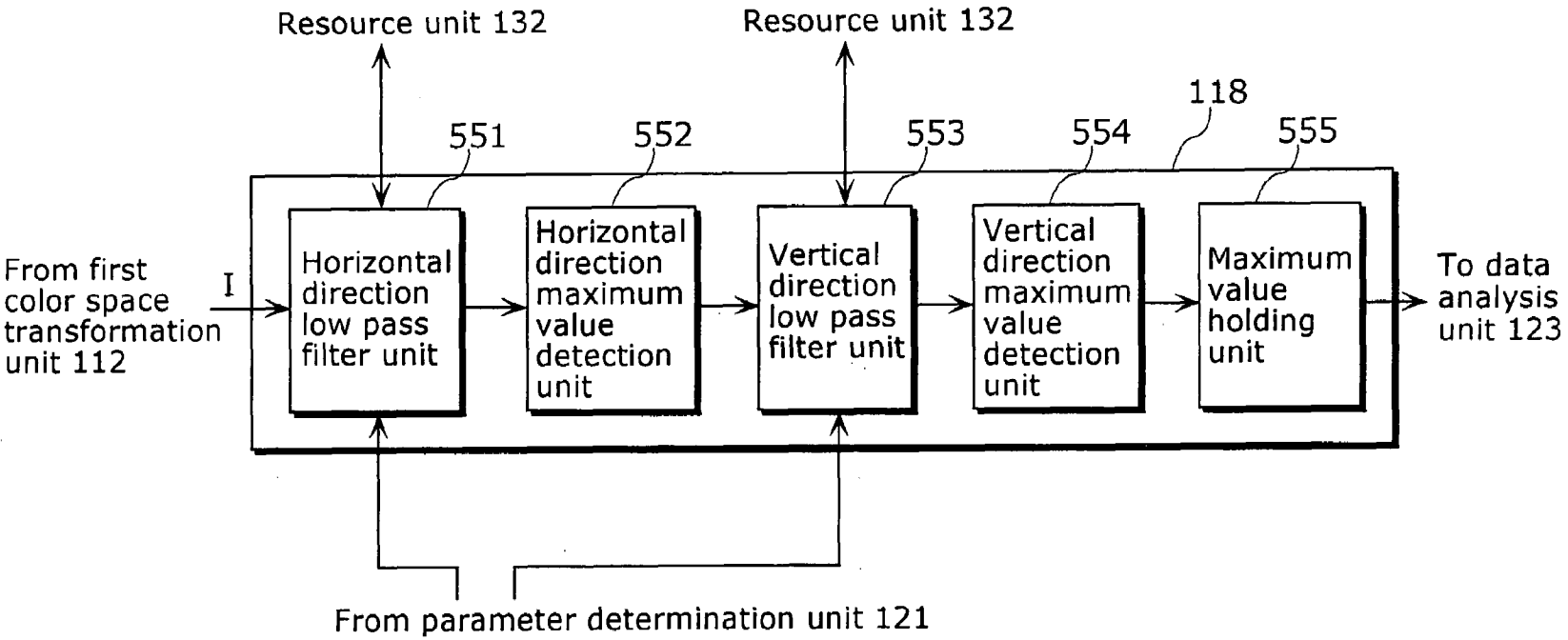
FIG. 9 is a block diagram showing a structure of a maximum value detection unit in the present embodiment.

FIG. 9 is a block diagram showing a structure of the maximum value detection unit 118. The maximum value detection unit 118 includes a horizontal direction low pass filter unit 551, a horizontal direction maximum value detection unit 552, a vertical direction low pass filter unit 553, a vertical direction maximum value detection unit 554 and a maximum value holding unit 555, detects the maximum brightness of each pixel in each frame from the brightness signal I outputted from the first color space transformation unit 112 for output.

The horizontal direction low pass filter unit 551 removes high frequency components in the horizontal direction of the brightness signal I outputted from the first color space transformation unit 112 based on the parameter values outputted from the parameter determination unit 121.

For that purpose, the horizontal direction low pass filter unit 551 determines a multiplier and a multiplicand based on the brightness signal I outputted from the first color space transformation unit 112 and the parameter values outputted from the parameter determination unit 121, outputs the determined multiplier and multiplicand to the resource unit 132, and obtains the result of multiplication performed by the multiplication unit 605 in the resource unit 132 from the multiplication unit 605. The horizontal direction low pass filter 551 removes high frequency components from the brightness signal I inputted serially from the first color space transformation unit 112 based on the obtained multiplication result, and outputs the resulting signal.

Figure 10:
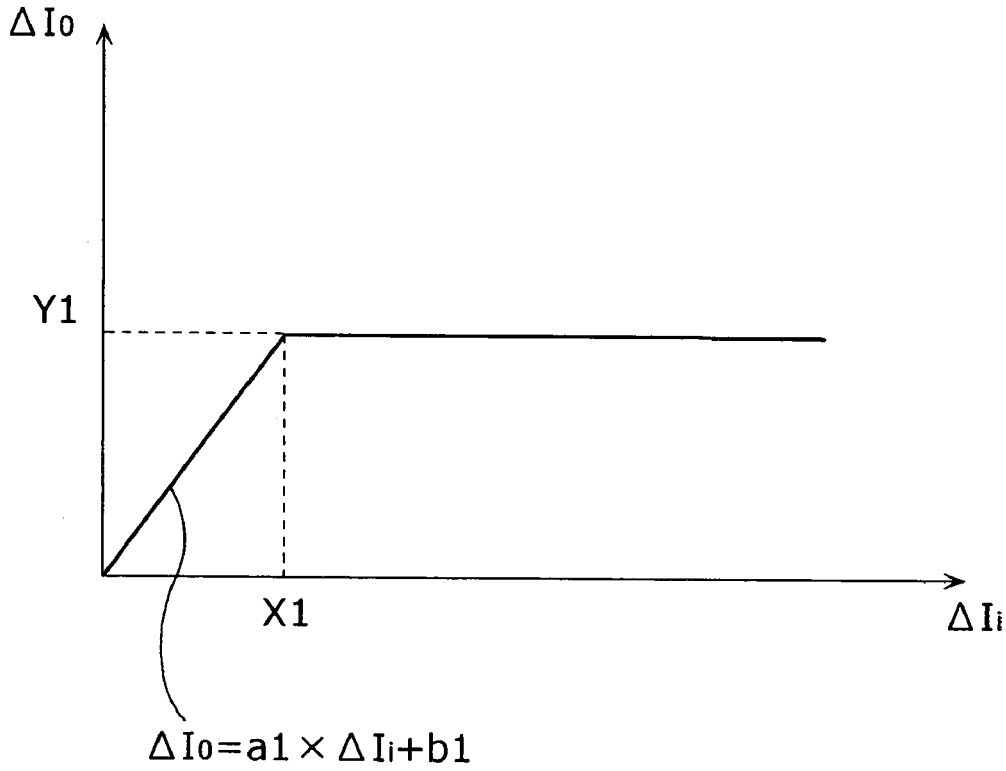
FIG. 10 is an illustration explaining an operation of a horizontal direction low pass filter unit in the present embodiment.

FIG. 10 is an illustration explaining an operation of the horizontal direction low pass filter unit 551.

When a rate of change in a brightness signal I of each pixel along the horizontal direction in a frame becomes a predetermined value or more, the horizontal direction low pass filter unit 551 removes high frequency components in the brightness signal I by determining the rate of change to a fixed value.

To be more specific, the horizontal direction low pass filter unit 551 obtains the brightness signal I of each pixel from the first color space transformation unit 112. As shown in FIG. 10, when the rate of change ΔIi in the brightness signal I of each pixel in the horizontal direction is less than X1, the horizontal direction low pass filter unit 551 causes the multiplication unit 605 to execute the operation of ΔIo=a1×ΔIi+b1 so as to transform the rate of change ΔIi into the rate of change ΔIo. Here, a1 and b1 are determined based on the parameter values outputted from the parameter determination unit 121. When the rate of change ΔIi is X1 or more, the horizontal direction low pass filter unit 551 causes the multiplication unit 605 to execute the operation of ΔIo=a1×X1+b1 (=Y1) so as to transform the rate of change ΔIi into a fixed value. Then, the horizontal direction low pass filter unit 551 outputs the brightness signal I corresponding to the rate of change ΔIo to the horizontal direction maximum value detection unit 552.

The horizontal direction maximum value detection unit 552 detects the maximum value in the horizontal direction on a pixel-by-pixel basis in each frame in the brightness signal I outputted from the horizontal direction low pass filter unit 551, and outputs the detection result together with the brightness signal I to the vertical direction low pass filter unit 553.

The vertical direction low pass filter unit 553 removes, based on the parameter values outputted from the parameter determination unit 121, high frequency components in the vertical direction in the brightness signal I outputted from the horizontal direction maximum value detection unit 552.

For that purpose, the vertical direction low pass filter unit 553 determines a multiplier and a multiplicand based on the brightness signal I outputted from the horizontal direction maximum value detection unit 552 and the parameter values outputted from the parameter determination unit 121, outputs the determined multiplier and multiplicand to the resource unit 132, and obtains the result of multiplication performed by the multiplication unit 605 of the resource unit 132 from the multiplication unit 605. Then, the vertical direction low pass filter 553 removes, based on the obtained multiplication result, high frequency components of the brightness signal I inputted serially from the horizontal direction maximum value detection unit 552, and outputs the resulting signal.

The operation of this vertical direction low pass filter unit 553 for removing the high frequency components is same as that of the horizontal direction low pass filter unit 551. In other words, the vertical direction low pass filter unit 553 causes the multiplication unit 605 to execute the multiplication using the rate of change in the brightness signal I of each pixel along the vertical direction in the frame.

The vertical direction maximum value detection unit 554 obtains the brightness signal I outputted from the vertical direction low pass filter unit 553, and detects the maximum value thereof on a pixel-by-pixel basis in the vertical direction in each frame to output it to the maximum value holding unit 555.

The maximum value holding unit 555 holds the value outputted from the vertical direction maximum value detection unit 554, that is, the maximum value of the brightness signal I of each pixel in each frame, and outputs it to the data analysis unit 123.

The multiplication unit 605 used by the maximum value detection unit 118 is included in the resource unit 132, and can be shared among respective units in the image display control unit 103. The resource control unit 131 assigns the resource subunit 610 including this multiplication unit 605 to the maximum value detection unit 118 at a predetermined timing to be mentioned later. Therefore, the maximum value detection unit 118 can use the multiplication unit 605 at that timing.

Figure 11:
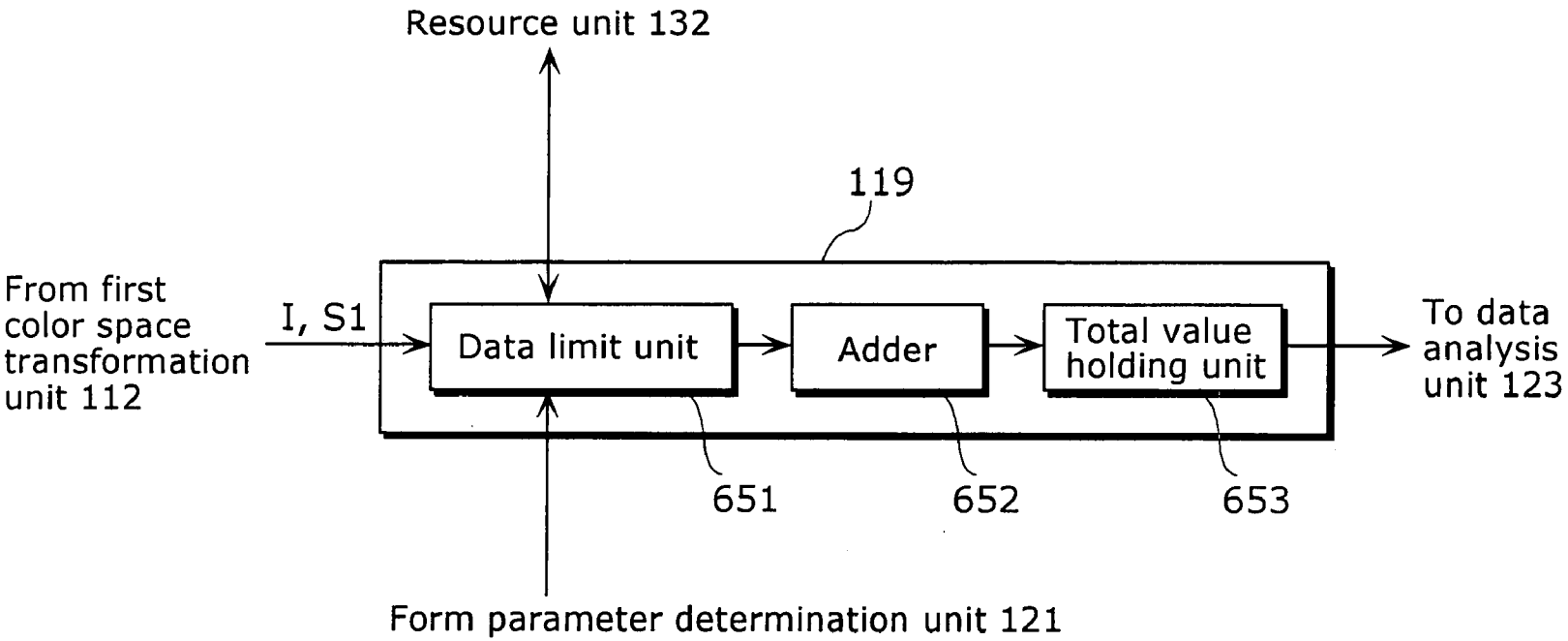
FIG. 11 is a block diagram showing a structure of a total value calculation unit in the present embodiment.

FIG. 11 is a block diagram showing a structure of the total value calculation unit 119. The total value calculation unit 119 includes a data limit unit 651, an adder 652 and a total value holding unit 653, and calculates respectively a total value of chroma signals and brightness signals of respective pixels in a frame. Approximate values of brightness and chroma of each frame are respectively specified by averaging these total values of the frame.

The data limit unit 651 outputs the brightness signal I and the chroma signal S1 of each pixel outputted by the first color space transformation unit 112 to the adder 652 not to exceed the effective upper limits of these signals.

More specifically, the data limit unit 651 calculates the upper limit effective for the brightness signal I of each pixel based on the parameter value outputted from the parameter determination unit 121 and the brightness signal of each pixel outputted from the first color space transformation unit 112, and also calculates the upper limit effective for the chroma signal S1 of each pixel based on the parameter value and the chroma signal S1 of each pixel outputted from the first color space transformation unit 112. Then, when the brightness signal I and the chroma signal S1 outputted from the first color space transformation unit 112 exceed the calculated upper limits, the data limit unit 651 determines those brightness signal I and chroma signal S1 to be the calculated upper limits and outputs them to the adder 652.

For calculating the upper limit of this brightness signal I, the data limit unit 651 calculates a multiplier and a multiplicand based on the brightness signal I of each pixel and the parameter value to output them to the resource unit 132, and obtains the result of multiplication of the multiplier and the multiplicand performed by the multiplication unit 605 in the resource unit 132 from the multiplication unit 605 so as to determine the result to be the upper limit. The upper limit of the chroma signal S1 is obtained in the same manner.

Figure 12:
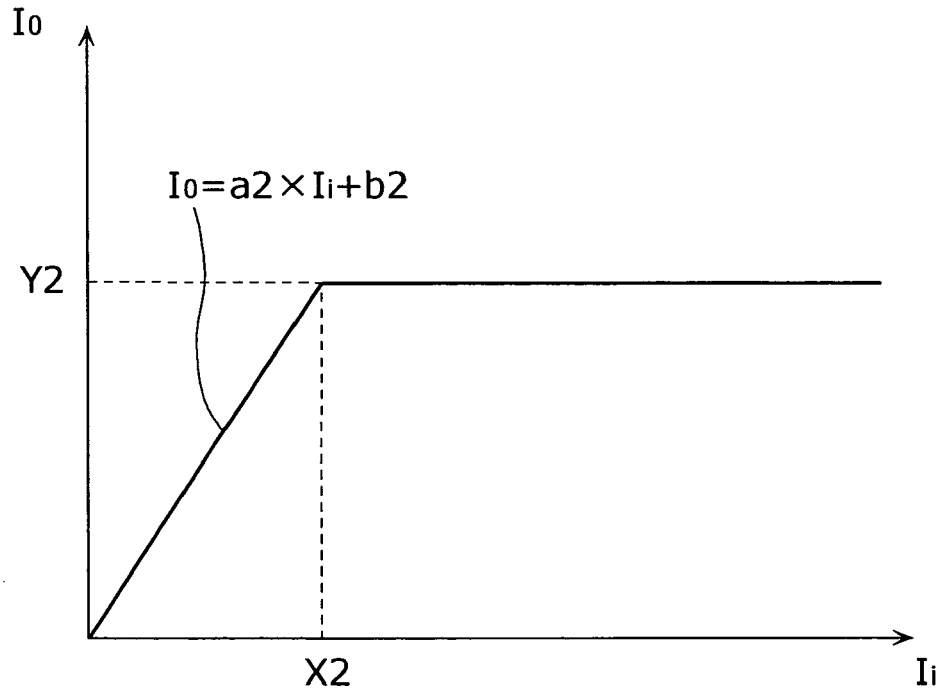
FIG. 12 is an illustration explaining an operation of a data limit unit in the present embodiment for a brightness signal.

FIG. 12 is an illustration explaining an operation performed by the data limit unit 651 for setting the upper limit of the obtained brightness signal I.

As shown in FIG. 12, the data limit unit 651 obtains the brightness signal I of each pixel from the first color space transformation unit 112. And when the brightness Ii indicated by the obtained brightness signal I is less than X2, the data limit unit 651 causes the multiplication unit 605 to execute the operation of Io=a2×Ii+b2 so as to transform the brightness Ii into the brightness Io. Here, a2 and b2 are determined based on the parameter values outputted from the parameter determination unit 121. Also, when the brightness Ii is X2 or more, the data limit unit 651 causes the multiplication unit 605 to execute the operation of Io=a2×X2+b2 (=Y1) so as to transform the brightness Ii into a fixed value. Then, the data limit unit 651 outputs the brightness signal I corresponding to the brightness Io to the adder 652.

Figure 13:
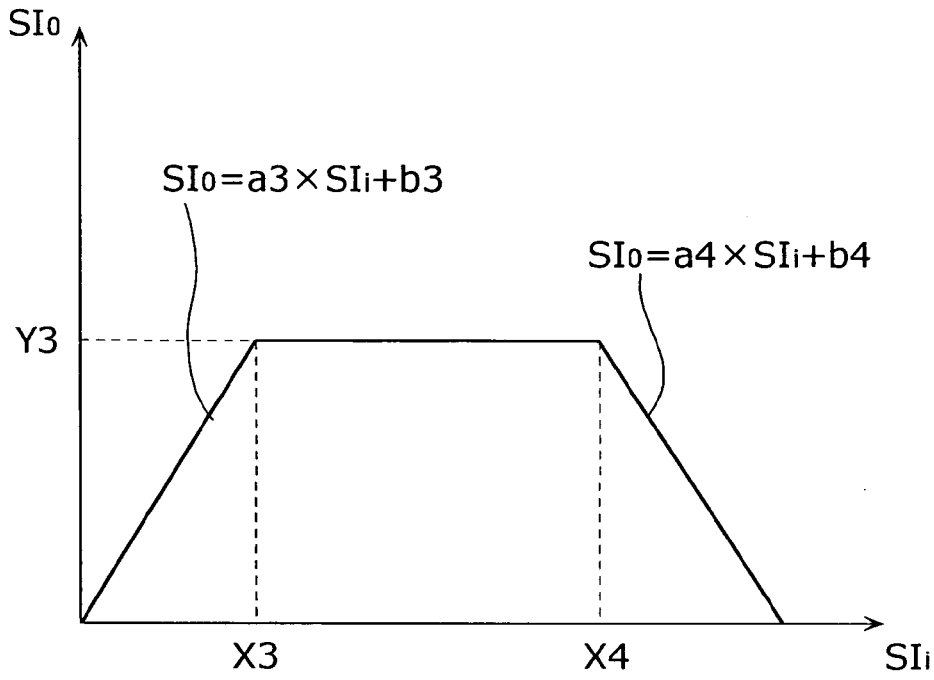
FIG. 13 is an illustration explaining an operation of the data limit unit in the present embodiment for a chroma signal.

FIG. 13 is an illustration explaining an operation performed by the data limit unit for setting the upper limit of the obtained chroma signal S1.

As shown in FIG. 13, the data limit unit 651 obtains the chroma signal S1 of each pixel from the first color space transformation unit 112. When the chroma S1*i* indicated by the obtained chroma signal S1 is less than X3, the data limit unit 651 causes the multiplication unit 605 to execute the operation of S1*o*=a3×S1*i*+b3 so as to transform the chroma S1*i* into the chroma S1*o*. Also, when the chroma S1*i* is not less than X3 but less than X4, the data limit unit 651 causes the multiplication unit 605 to execute the operation of S1*o*=a3×X3+b3 (=Y3) so as to transform the chroma S1*i* into a fixed value. Further, when the chroma S1*i* is X4 or more, the data limit unit 651 causes the multiplication unit 605 to execute the operation of S1*o*=a4×S1*i*+b4 so as to transform the chroma S1*i* into the chroma S1*o*. Here, the above-mentioned a3, a4, b3 and b4 are determined based on the parameter values outputted from the parameter determination unit 121. Then, the data limit unit 651 outputs the chroma signal S1 corresponding to the chroma S1*o* to the adder 652.

The adder 652 adds the brightness signal I of each pixel in each frame outputted from the data limit unit 651 to calculate the total value and outputs it to the total value holding unit 653, and adds the chroma signal S1 of each pixel in each frame to calculate the total value and outputs it to the total value holding unit 653.

The total value holding unit 653 holds the total value of the brightness signals I of respective pixels in each frame and the total value of the chroma signals S1 in each frame outputted from the adder 652, and outputs them to the data analysis unit 123.

The multiplication unit 605 used by the total value calculation unit 119 is included in the resource unit 132, and can be shared among respective units in the image display control unit 103. The resource control unit 131 assigns the resource subunit 610 including this multiplication unit 605 to the total value calculation unit 119 at a predetermined timing to be mentioned later. Therefore, the total value calculation unit 119 can use the multiplication unit 119 at that timing.

The data analysis unit 123 calculates the average of the brightness signals I and the average of the chroma signals S1 of respective pixels in each frame based on the total value of the brightness signals I and the total values of the chroma signals S1 of respective pixels in each frame outputted from the total value calculation unit 119, and analyzes the state of the image in each frame based on the respective averages and the maximum value in the brightness signals I of respective pixels in each frame outputted from the maximum value detection unit 118. The data analysis unit 123 outputs a signal indicating an amount of control for controlling properly the brightness signal and the chroma signal according to the image state to the parameter determination unit 121, and also outputs a signal indicating an amount of control for controlling properly an amount of light emitted by the backlight 102 to the backlight control unit 124.

The backlight control unit 124 calculates a control value for controlling the amount of light emitted by the backlight 102 according to the signal (amount of control) outputted from the data analysis unit 123, and outputs it to the backlight 102.

Next, the image signal transformation unit 140 will be explained. The image signal transformation unit 140 includes the brightness transformation unit 113 and the chroma transformation unit 114, and transforms the brightness signal I and the chroma signal S1 of each pixel based on the image state detected by the image state detection unit 120.

The brightness transformation unit 113 performs operational processing on the brightness signal I outputted from the first color space transformation unit 112, based on the parameter value determined by the parameter determination unit 121, so as to transform the brightness signal I into a brightness signal I' and outputs it to the second color space transformation unit 115.

To be more specific, the brightness transformation unit 113 includes the calculation unit 600 as shown in FIG. 8. Both of the multiplier data and the multiplicand data which are inputted to the multiplier determination unit 601 and the multiplicand determination unit 602 of the calculation unit 600 respectively by the brightness transformation unit 113 are the brightness signal I of each pixel outputted from the first color space transformation unit 112.

As described above, the data analysis unit 123 outputs a signal indicating an amount of control for controlling properly the brightness signal and the chroma signal according to the image state in each frame detected by the image state detection unit 120. The parameter determination unit 121 determines the parameter value for transforming the brightness signal I based on the amount of control.

The calculation unit 600 in the brightness transformation unit 113 determines the multiplier based on the brightness signal I indicating the inputted multiplier data and the parameter value determined by the parameter determination unit 121 with reference to the multiplier table 604 of the resource unit 132, and also determines the multiplicand based on the brightness signal I indicating the inputted multiplicand data and the parameter value determined by the parameter determination unit 121. Then, the calculation control unit 603 of the calculation unit 600 outputs the multiplier and the multiplicand to the multiplication unit 605 of the resource unit 132, and the multiplication unit 605 obtains the result of multiplication from the multiplication unit 605 and outputs the result, as a transformed brightness signal I', to the second color space transformation unit 115.

More specifically, the brightness transformation unit 113 causes the multiplication unit 605 to execute the multiplication of (a multiplier specified from the multiplier table 604 based on the brightness signal I and the parameter value)×(a multiplicand specified based on the brightness signal I and the parameter value) so as to transform the brightness signal I into the brightness signal I'.

As described above, the brightness transformation unit 113 transforms the brightness signal I according to the image state of each frame. For example, if an image of a frame has low brightness as a whole, the brightness transformation unit 113 transforms the brightness signal I so as to increase the brightness considering that there is room in the frame to increase the brightness up to the acceptable limit. For that purpose, upon receipt of a control signal from the data analysis unit 123, the backlight control unit 124 decreases the amount of light emitted from the backlight 102 according to the increased brightness. As a result, the amount of light emitted from the backlight is reduced without changing the state of actually visible image, and thus reduction of power consumption can be achieved.

The resource subunit 610 consisting of the multiplier table 604 and the multiplication unit 605 used by the brightness transformation unit 113 is included in the resource unit 132, and can be shared by respective units in the image display control unit 103. The resource control unit 131 assigns this resource subunit 610 to the brightness transformation unit 113 at a predetermined timing to be mentioned later. As a result, the brightness transformation unit 113 can use the multiplier table 604 and the multiplication unit 605 at that timing.

Here, the brightness transformation unit 113 transforms the brightness signal I based on the image state of each frame detected by the image state detection unit 120, but to be more specific, it transforms the brightness signal I in a current frame based on the image state detected in the previous frame. Since an image signal is inputted for only 10~15 frames per second, there is little difference in the image signal between frames. Therefore, there is no visual problem even if the brightness signal I of the current frame is transformed based on the image state detected in the previous frame.

Note that a brightness signal I in a frame may be transformed based on a detected state of an image of the frame. In this case, if an image signal for one frame is stored in a memory or the like and a state of the frame is detected, the brightness signal I of the frame may be transformed based on the detected state.

Next, the chroma transformation unit 114 will be explained. The chroma transformation unit 114 performs operational processing on the chroma signal S1 outputted from the first color space transformation unit 112 based on the parameter values determined by the parameter determination unit 121 so as to transform it into a chroma signal S1' and outputs it to the second color space transformation unit 115.

The chroma transformation unit 114 includes the calculation unit 600 as shown in FIG. 8. The multiplier data and the multiplicand data inputted respectively to the multiplier determination unit 601 and the multiplicand determination unit 602 in the calculation unit 600 are both obtained based on the chroma signal S1 of each pixel outputted from the first color space transformation unit 112.

As described above, the data analysis unit 123 outputs a signal indicating an amount of control for controlling properly the brightness signal and the chroma signal according to the image state of each frame detected by the image state detection unit 120 to the parameter determination unit 121. The parameter determination unit 121 determines the parameter values for transforming the chroma signal S1 based on the control amount.

The calculation unit 600 included in the chroma transformation unit 114 determines a multiplier with reference to the multiplier table 604 of the resource unit 132 based on the chroma signal S1 that is inputted multiplier data and the parameter value determined by the parameter determination unit 121, and also determines a multiplicand based on the chroma signal S1 that is inputted multiplicand data and the parameter value determined by the parameter determination unit 121. Then, the calculation control unit 603 of the calculation unit 600 outputs the multiplier and the multiplicand to the multiplication unit 605 of the resource unit 132, obtains the result of multiplication from the multiplication unit 605, and outputs it as a transformed chroma signal S1' to the second color space transformation unit 115.

More specifically, the chroma transformation unit 114 causes the multiplication unit 605 to execute the multiplication of (a multiplier specified from the multiplier table 604 based on the chroma signal S1 and the parameter value)×(a multiplicand specified based on the chroma signal S1 and the parameter value) so as to transform the chroma signal S1 into the chroma signal S1'.

As described above, the chroma transformation unit 114 transforms the chroma signal S1 according to the image state of each frame. For example, if an image of a frame has low chroma as a whole, the chroma transformation unit 114 transforms the chroma signal S1 so as to increase the chroma considering that there is room in the frame to increase the chroma up to the acceptable limit. For that purpose, upon receipt of a control signal from the data analysis unit 124, the backlight control unit 124 decreases the amount of light emitted from the backlight 102 according to the increased chroma. As a result, the amount of light emitted from the backlight is reduced without changing the state of actually visible image, and thus reduction of power consumption can be achieved.

The resource subunit 610 consisting of the multiplier table 604 and the multiplication unit 605 used by the chroma transformation unit 114 is included in the resource unit 132, and can be shared among respective units in the image display control unit 103. The resource control unit 131 assigns this resource subunit 610 to the chroma transformation unit 114 at a predetermined timing to be mentioned later. As a result, the chroma transformation unit 114 can use the multiplier table 604 and the multiplication unit 605 at that timing.

Here, the chroma transformation unit 114 transforms the chroma signal S1 based on the image state of each frame detected by the image state detection unit 120, but to be more specific, it transforms the chroma signal S1 in a current frame based on the image state detected in the previous frame. Since an image signal is inputted for only 10~15 frames per second, there is little difference in the image signal between frames. Therefore, there is no visual problem even if the chroma signal S1 of the current frame is transformed based on the image state detected in the previous frame.

Note that a chroma signal S1 in a frame may be transformed based on a detected state of an image of the frame. In this case, if an image signal for one frame is stored in a memory or the like and a state of the frame is detected, the chroma signal S1 of the frame may be transformed based on the detected state.

Next, the second color space transformation unit 115 will be explained.

Figure 14:
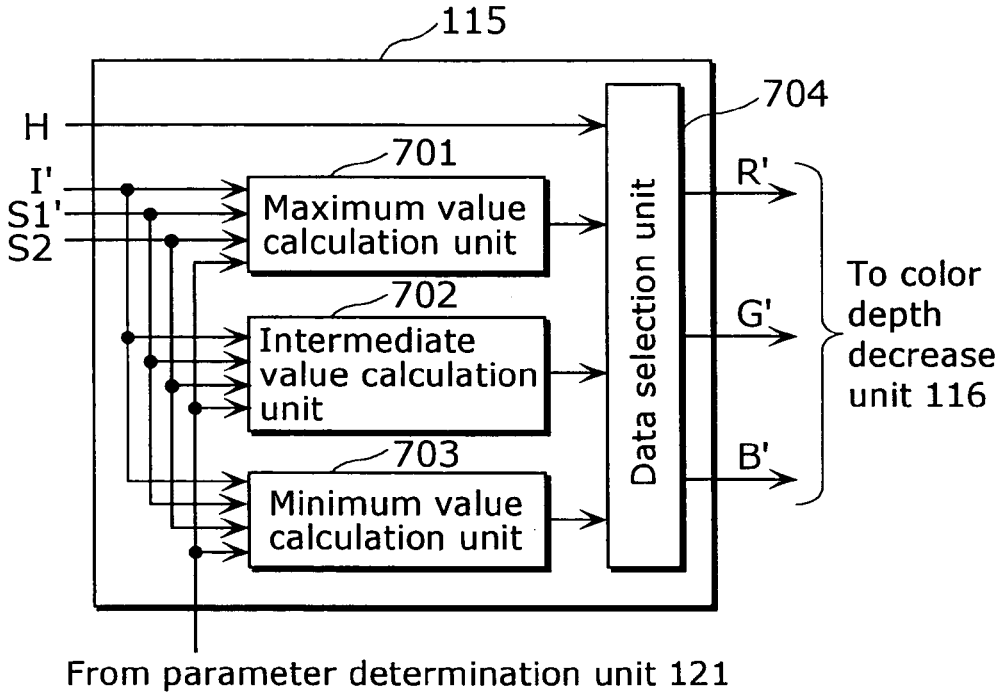
FIG. 14 is a block diagram showing a structure of a second color space transformation unit in the present embodiment.

FIG. 14 is a block diagram showing an example of an internal structure of the second color space transformation unit 115. The second color space transformation unit 115 includes a maximum value calculation unit 701, an intermediate value calculation unit 702, a minimum value calculation unit 703 and a data selection unit 704.

The second color space transformation unit 115 generates color component signals R', G' and B' based on the brightness signal I' outputted from the brightness transformation unit 113, the chroma signal S1' outputted from the chroma transformation unit 114, the hue signal H and the chroma signal S2 outputted from the first color space transformation unit 112 and the parameter values outputted from the parameter determination unit 121, and outputs them to the color depth decrease unit 116.

Here, the maximum value calculation unit 701, the intermediate value calculation unit 702 and the minimum value calculation unit 703 respectively include the calculation units 600 as shown in FIG. 8.

In each of the maximum value calculation unit 701, the intermediate value calculation unit 702 and the minimum value calculation unit 703, the multiplier data inputted to the multiplier determination unit 601 of the calculation unit 600 and the multiplicand data inputted to the multiplicand determination unit 602 are respectively the values obtained based on any of combinations of the above-mentioned brightness signal I', chroma signal S1' and chroma signal S2.

The calculation unit 600 in each of the maximum value calculation unit 701, the intermediate value calculation unit 702 and the minimum value calculation unit 703 determines the multiplier based on the value obtained based on any of the above combinations that is the inputted multiplier data and the parameter value determined by the parameter determination unit 121 with reference to the multiplier table 604 of the resource unit 132, and also determines the multiplicand based on the value obtained based on any of the above combinations that is the inputted multiplicand data and the parameter value determined by the parameter determination unit 121.

The calculation control unit 603 of the calculation unit 600 in each of the maximum value calculation unit 701, the intermediate value calculation unit 702 and the minimum value calculation unit 703 outputs the determined multiplier and multiplicand to the multiplication unit 605 of the resource unit 132, obtains the result of multiplication performed by the multiplication unit 605 from the multiplication unit 605, and outputs the maximum value, the intermediate value and the minimum value that are the results of their calculations to the data selection unit 704.

More specifically, each of the maximum value calculation unit 701, the intermediate value calculation unit 702 and the minimum value calculation unit 703 causes the multiplication unit 605 to perform the multiplication of (multipliers specified with reference to the multiplier table 604 based on values obtained based on combinations of a brightness signal I', a chroma signal S1' and a chroma signal S2 and a parameter value)×(multiplicands specified based on values obtained based on the combinations of the brightness signal I', the chroma signal S1' and the chroma signal S2 and a parameter value).

The maximum value calculation unit 701 outputs the maximum value out of the results of the multiplication obtained by the above combinations, the intermediate value calculation unit 702 outputs the intermediate value out of the results of the multiplication obtained by the above combinations, and the minimum value calculation unit 703 outputs the minimum value out of the results of the multiplication obtained by the above combinations. Note that the parameter values are different for the maximum value calculation unit 701, the intermediate value calculation unit 702 and the minimum value calculation unit 703 respectively.

The data selection unit 704 selects any of the maximum value, the intermediate value and the minimum value that are the results of calculations outputted from the maximum value calculation unit 701, the intermediate value calculation unit 702 and the minimum value calculation unit 703 based on the hue signal H outputted from the first color space transformation unit 112, and outputs the selected one as color component signals R', G' and B' to the color depth decrease unit 116.

The resource subunit 610, consisting of the multiplier table 604 and the multiplication unit 605 used by the second color space transformation unit 115, is included in the resource unit 132, and can be shared among respective units in the image display control unit 103. The resource control unit 131 assigns this resource subunit 610 to the second color space transformation unit 115 at a predetermined timing to be mentioned later. As a result, the second color space transformation unit 115 can use the multiplier table 604 and the multiplication unit 605 at that timing.

Next, the color depth decrease unit 116 will be explained.

Figure 15:
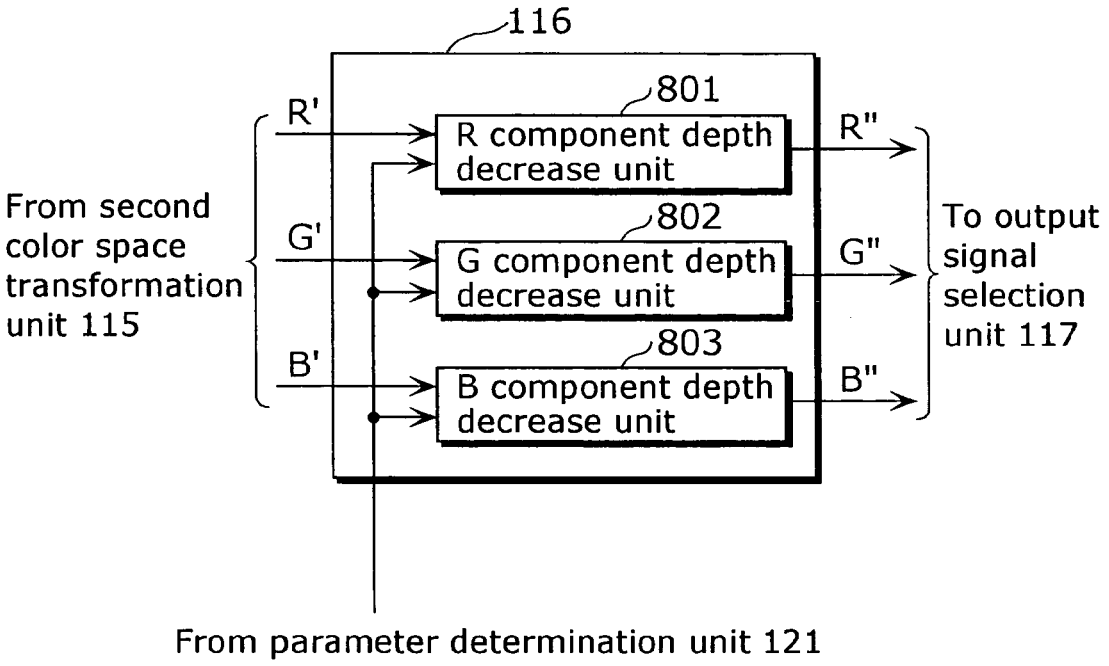
FIG. 15 is a block diagram showing a structure of a color depth decrease unit in the present embodiment.

FIG. 15 is a block diagram showing a structure of the color depth decrease unit 116. The color depth decrease unit 116 includes an R component depth decrease unit 801, a G component depth decrease unit 802 and a B component depth decrease unit 803. This color depth decrease unit 116 obtains color component signals R', G' and B' outputted from the second color space transformation unit 115, changes the color tones respectively in these color component signals, and outputs the resulting signals to the output signal selection unit 117. For example, when each component signal is 8 bits, the color depth decrease unit 116 performs dithering on the signal to transform it into a displayable signal of 5 bits.

The R component depth decrease unit 801, the G component depth decrease unit 802 and the B component depth decrease unit 803 change the color tones in the color component signals R', G' and B' outputted from the second color space transformation unit 105 according to the parameter values determined by the parameter determination unit 121, and outputs the resulting image signals consisting of component signals R", G" and B" to the output signal selection unit 117. For that purpose, the parameter determination unit 121 sets the parameter values according to a user's entry. The parameter determination unit 121 can also determine the parameter values depending on a state of an image in each frame.

Figure 16:
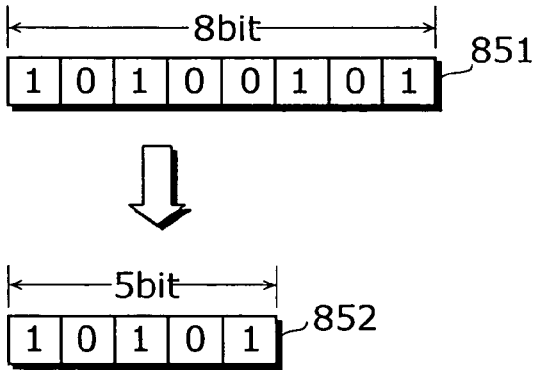
FIG. 16 is an illustration explaining change of a color tone by the color depth decrease unit in the present embodiment.

FIG. 16 is an illustration showing an example of change of a color tone in a color component signal outputted from the second color space transformation unit 115.

In this example, each of the R component depth decrease unit 801, the G component depth decrease unit 802 and the B component depth decrease unit 803 performs effective color depth decrease processing (such as dithering) on a component signal 851 having a color tone of 8 bits so as to transform it into a component signal 852 having a color tone of 5 bits.

The output signal selection unit 117 selects, on a frame-by-frame basis, either one of an image signal inputted to the image display control unit 103 and an image signal outputted from the color depth decrease unit 116 based on the parameter value determined by the parameter determination unit 121 according to the user's instruction, and outputs the selected image signal to a display controller 122.

The display controller 122 calculates a light transmittance in liquid crystals of the LCD screen 101 based on the image signal selected by the output signal selection unit 117 and outputs it to the LCD screen 101.

The resource control unit 131 in the present embodiment will be explained below.

Figure 17:
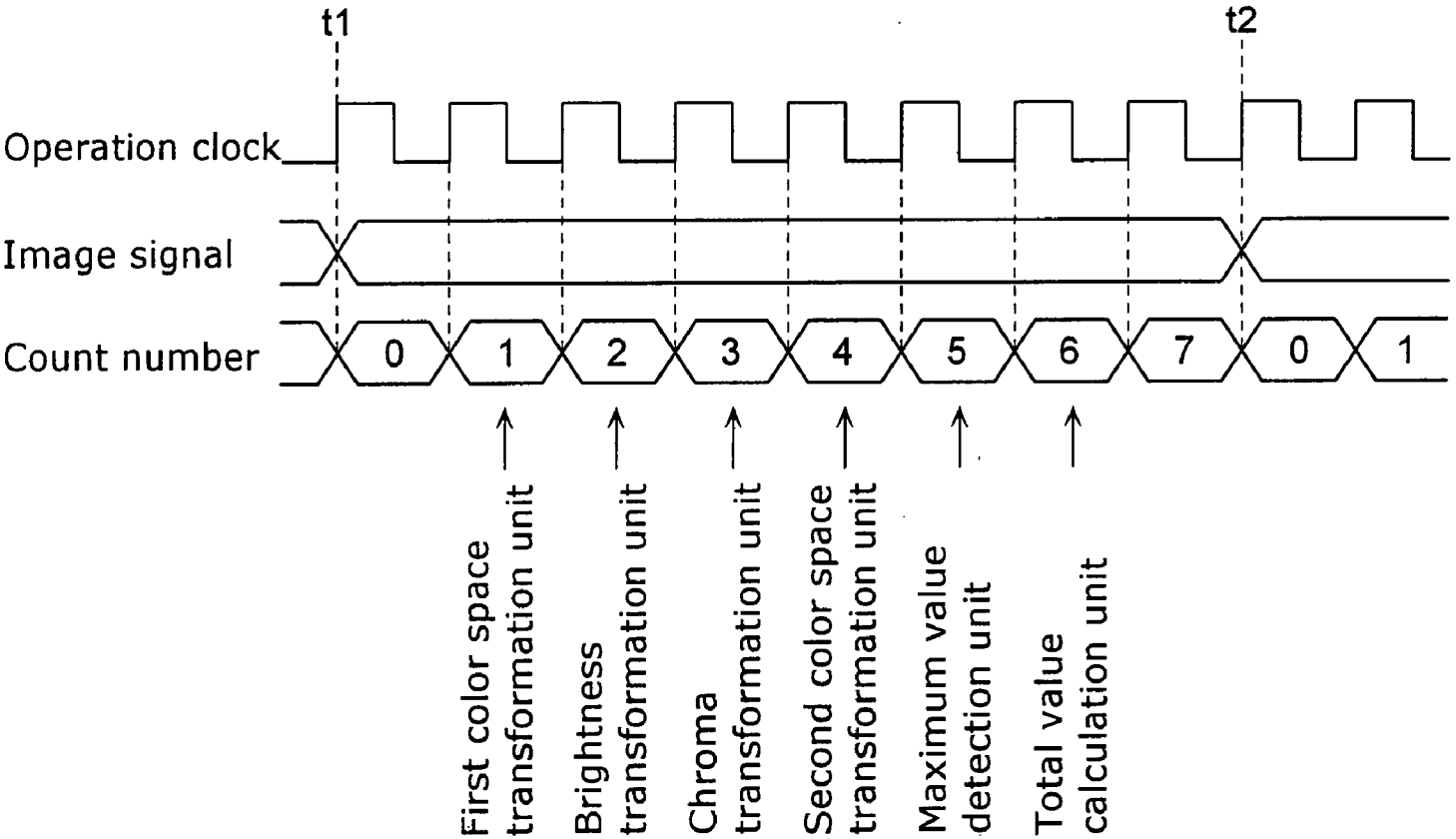
FIG. 17 is an illustration showing assignment of resources based on an operation clock, image signal input timing and a count number of the operation clock in the present embodiment.

FIG. 17 is a time chart showing an operation clock, an image signal input timing and how the resource subunits 610 are assigned to respective units.

In FIG. 17, the upper row shows the operation clock inputted to the resource control unit 131, the middle row shows input timing of an image signal inputted to the image display control apparatus 103, and the lower row shows how the resource subunits 610 are assigned according to the count number of the operation clock inputted to the resource control unit 131.

As shown in FIG. 17, a time t1 and a time t2 are times when an image signal is inputted on a pixel-by-pixel basis, and the image signal is inputted at every 8 cycles of the operation clock on a pixel-by-pixel basis.

When an image signal is inputted to the image display control unit 103 on a pixel-by-pixel basis (time t1), the resource control unit 131 starts counting the cycle of the operation clock inputted by the clock unit 135. The resource control unit 131 assigns the resource subunits 610 in the following manner: when the count number is 1, it assigns the resource subunits 610 of the resource unit 132 to the first color space transformation unit 112; when the count number is 2, it assigns the resource subunits 610 to the brightness transformation unit 113 instead of the first color space transformation unit 112; when the count number is 3, it assigns the resource subunits 610 to the chroma transformation unit 114 instead of the brightness transformation unit 113; when the count number is 4, it assigns the resource subunits 610 to the second color space transformation unit 115 instead of the chroma transformation unit 114; when the count number is 5, it assigns the resource subunits 610 to the maximum value detection unit 118 instead of the second color space transformation unit 115; and when the count number is 6, it assigns the resource subunits 610 to the total value calculation unit 119 instead of the maximum value detection unit 118.

More specifically, each unit such as the brightness transformation unit 113 can use the resources such as the multiplication unit 605 in the resource subunit 610 at the assigned timing. For assigning the resource subunits 610, the resource control unit 131 counts the number of the resource subunits 610 which are to be assigned to the first color space transformation unit 112, the brightness transformation unit 113, the chroma transformation unit 114, the second color space transformation unit 115, the maximum value detection unit 118 and the total value calculation unit 119 according to the processing performed by them respectively. For example, when two resource subunits 610 are required for the processing performed by the first color space transformation unit 112 and three resource subunits 610 are required for the processing performed by the brightness transformation unit 113, the resource control unit 131 assigns two resource subunits 610 to the first color space transformation unit 112 at the timing of the count number 1, and then inhibits assignment to the first color space transformation unit 112 so as to assign these two resource subunits 610 and another resource subunit 610 to the brightness transformation unit 113.

The resource subunits 610 are assigned sequentially to the hue calculation unit 502, the brightness calculation unit 503, the first chroma calculation unit 504 and the second chroma calculation unit 505 in the first color space transformation unit 112. After the resource control unit 131 assigns the resource subunits 610 to the hue calculation unit 502, the brightness calculation unit 503, the first chroma calculation unit 504 and the second chroma calculation unit 505 in the first color space transformation unit 112 respectively, these units may perform their processing simultaneously using the resource subunits 610 assigned respectively to them.

Next, procedures executed by the resource control unit 131 for assigning the resource subunits 610 of the resource unit 132.

Figure 18:
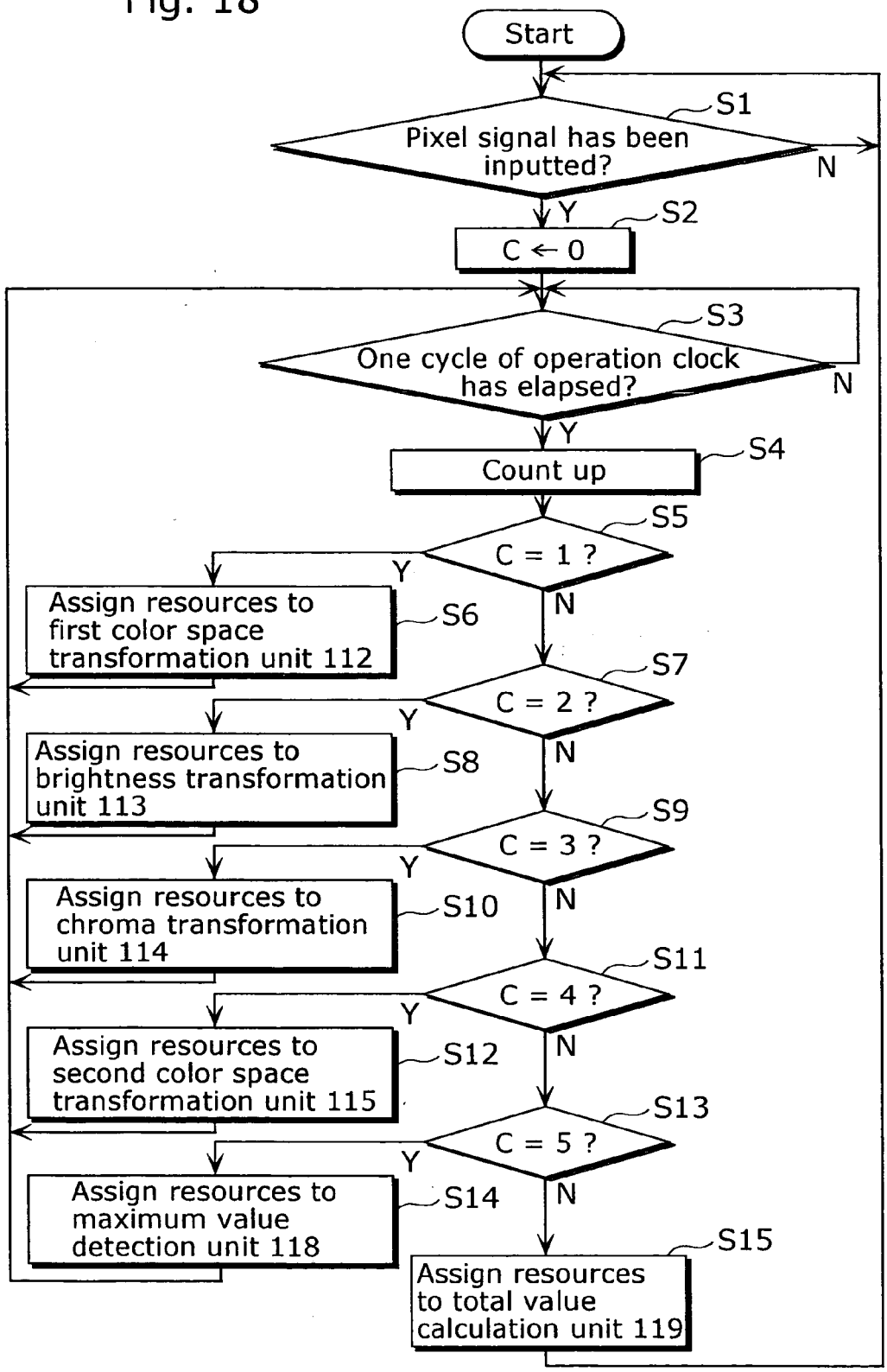
FIG. 18 is a flowchart showing an operation of a resource control unit in the present embodiment.

FIG. 18 is a flowchart showing an operation of the resource control unit 131.

First, the resource control unit 131 judges whether a pixel signal indicating one pixel among an image signal has been inputted to the image display control unit 103 or not (Step S1), and when it judges that the pixel signal has been inputted (Y in Step S1), it resets the count number C in the built-in counter (Step S2). In the example as shown in FIG. 18, a pixel signal is inputted in every 6 cycles of the operation clock.

Next, the resource control unit 131 judges whether one cycle of the operation clock inputted from the clock unit 135 has elapsed or not (Step S3), and when it judges that it has elapsed (Y in Step S3), it starts counting up the counter (Step S4).

The resource control unit 131 judges whether the count number C of the counter is 1 or not (Step S5), and when the count number C is 1 (Y in Step S5), it assigns the resource subunits 610 of the resource unit 132 to the first color space transformation unit 112 (Step S6) and judges again whether the cycle of the operation clock has elapsed or not (Step S3).

When judging that the count number C of the counter is not 1 (N in Step S5), the resource control unit 131 judges whether the count number C is 2 or not (Step S7), and when it judges that the count number C is 2, it assigns the resource subunits 610 of the resource unit 132 to the brightness transformation unit 113 instead of the first color space transformation unit 112 (Step S8), and judges again whether one cycle of the operation clock has elapsed or not (Step S3).

When judging that the count number C of the counter is not 2 (N in Step S7), the resource control unit 131 judges whether the count number C is 3 or not (Step S9), and when it judges that the count number C is 3, it assigns the resource subunits 610 of the resource unit 132 to the chroma transformation unit 114 instead of the brightness transformation unit 113 (Step S10), and judges again whether one cycle of the operation clock has elapsed or not (Step S3).

When judging that the count number C of the counter is not 3 (N in Step S9), the resource control unit 131 judges whether the count number C is 4 or not (Step S11), and when it judges that the count number C is 4, it assigns the resource subunits 610 of the resource unit 132 to the second color space transformation unit 115 instead of the chroma transformation unit 114 (Step S12), and judges again whether one cycle of the operation clock has elapsed or not (Step S3).

When judging that the count number C of the counter is not 4 (N in Step S11), the resource control unit 131 judges whether the count number C is 5 or not (Step S13), and when it judges that the count number C is 5, it assigns the resource subunits 610 of the resource unit 132 to the maximum value detection unit 118 instead of the second color space transformation unit 115 (Step S14), and judges again whether one cycle of the operation clock has elapsed or not (Step S3).

When judging that the count number C of the counter is not 5 (N in Step S13), the resource control unit 131 assigns the resource subunits to the total value calculation unit 119 instead of the maximum value detection unit 118 (Step S15), and judges again whether the pixel signal has been inputted or not (Step S1).

According to the image display apparatus 100 in the present embodiment, the resource control unit 131 assigns sequentially the resource subunits 610 equipped with the multiplier tables 604 and the multiplication units 605 to respective units such as the first color space transformation unit 112, the brightness transformation unit 113, the chroma transformation unit 114, the maximum value detection unit 118, the total value calculation unit 119 and the second color space transformation unit 115, and these units use the assigned resource subunits 610 when performing their processing, so these units such as the brightness transformation unit 113 can share the use of the same resource subunits 610. Therefore, the resource subunits 610 in the image display control unit 103 can be reduced substantially, and thus the circuit size of the image display apparatus 100 can also be reduced.

If a mobile terminal such as a mobile phone is equipped with the image display apparatus 100 in the present embodiment, an interval between pixels in an image signal inputted to the image display control unit 103 is much more longer than a cycle of an operation clock of the mobile terminal because the screen size of the LCD screen 101 is small. Also, since a rate at which a memory storing the image signal which is to be inputted to the image display control unit 103 transfers the image signal to the image display control unit 103 is slower than the cycle of the operation clock of the mobile terminal, an interval between pixels in an image signal inputted to the image display control unit 103 is generally very long.

As described above, when an interval between pixels in an image signal inputted to the image display control unit 103 is long, the resource subunits 610 which are small in size or number can be shared among respective units by assigning the resource subunits 610 to those units while switching them adaptively at a timing according to the count number of the operation clock or the like. As a result, redundant resource subunits 610 are omitted and thus the circuit size of a device such as a mobile terminal equipped with the image display control unit 103 can be reduced. The present embodiment is extremely practical and effective to implementation to a mobile terminal typified by a mobile phone.

On the other hand, if the transfer rate of the memory storing an image signal which is to be inputted to the image display control unit 103 is fast and an interval between pixels in the image signal inputted to the image display control unit 103 is short, the resource control unit 131 may increase the number of resource subunits 610 which are to be assigned to respective units such as the brightness transformation unit 113 and the maximum value detection unit 118.

To be more specific, in case of a high-speed transfer rate, the resource control unit 131 assigns the resource subunits 610 simultaneously to the first color space transformation unit 112, the brightness transformation unit 113 and other units, and causes the resource subunits 610 assigned to those units to perform multiplications in parallel.

Figure 19:
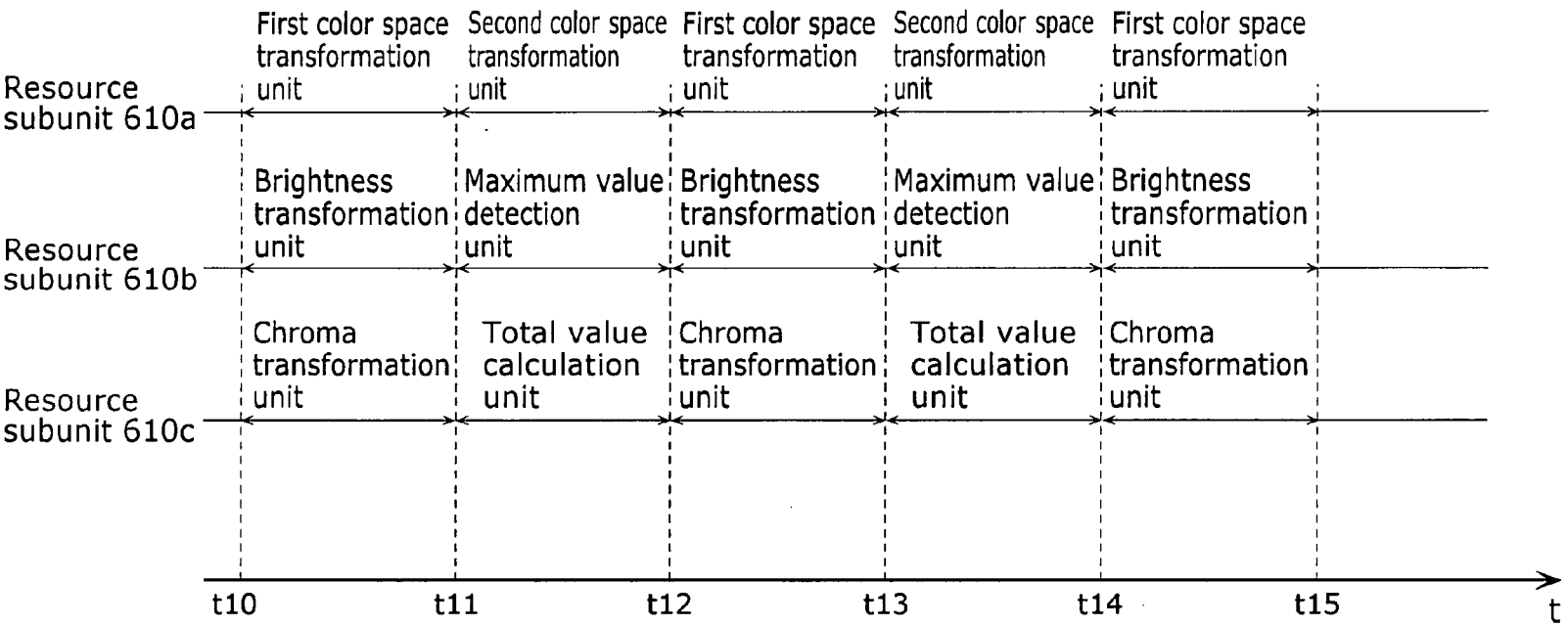
FIG. 19 is a flowchart showing another operation of the resource control unit in the present embodiment.

FIG. 19 is an illustration showing an example of an operation performed by the resource control unit 131 for assigning three resource subunits 610 in parallel. Here, the resource subunits 610 are shown as resource subunits 610*a*, 610*b* and 610*c* in order to distinguish between them.

For example, as shown in FIG. 19, during a period from a time t10 to a time t11, the resource control unit 131 assigns the resource subunit 610*a* to the first color space transformation unit 112, the resource subunit 610*b* to the brightness transformation unit 113 and the resource subunit 610*c* to the chroma transformation unit 114, respectively. As a result, the first color space transformation unit 112, the brightness transformation unit 113 and the chroma transformation unit 114 cause the three resource subunits 610*a*, 610*b* and 610*c* to execute multiplications in parallel.

Next, during a period from a time t11 to a time t12, the resource control unit 131 reassigns the resource subunit 610*a* to the second color space transformation unit 115 instead of the first color space transformation unit 112, the resource subunit 610*b* to the maximum value detection unit 118 instead of the brightness transformation unit 113, and the resource subunit 610*c* to the total value calculation unit 119 instead of the chroma transformation unit 114, respectively. As a result, the second color space transformation unit 115, the maximum value detection unit 118 and the total value calculation unit 119 cause the three resource subunits 610*a*, 610*b* and 610*c* to execute multiplications in parallel.

Then, in periods subsequent to a time t12, the assignments of the three resource subunits 610*a*, 610*b* and 610*c* performed during the periods from t10 to t11 and from t11 to t12 are executed repeatedly.

The image display apparatus 100 according to the present invention has been explained using the present embodiment, but the present invention is not limited to this embodiment.

For example, in the present embodiment, the image display apparatus 100 includes a pair of the LCD screen 101 and the backlight 102, but it may include plural pairs of the LCD screens 101 and the backlights 102, and these plural pairs may vary in size.

For example, when the image display apparatus 100 includes two pairs of the LCD screens 101 and the backlights 102 which are different from each other in size, the parameter determination unit 121 selects either of these LCD screens 101 for displaying an image based on a user's operation. The respective units in the image display control unit 103 perform their processing depending on the size of the selected LCD screen 101 so as to display the image on that LCD screen 101.

Here, when two pairs of the LCD screens 101 and the backlights 102 which are different from each other in size are adaptively switched for use, as mentioned above, the resource control unit 131 varies the number of resource subunits 610 which are to be assigned to the respective units such as the first color space transformation unit 112 and the brightness transformation unit 113 depending on the sizes thereof.

To be more specific, the resource control unit 131 assigns a lot of resource subunits 610 to the units such as the first color space transformation unit 112 when an image is displayed in the larger LCD screen 101, whereas it assigns a fewer number of resource subunits 610 when an image is displayed in the smaller LCD screen 101 because of a longer input interval of pixels included in an image signal.

Figure 20:
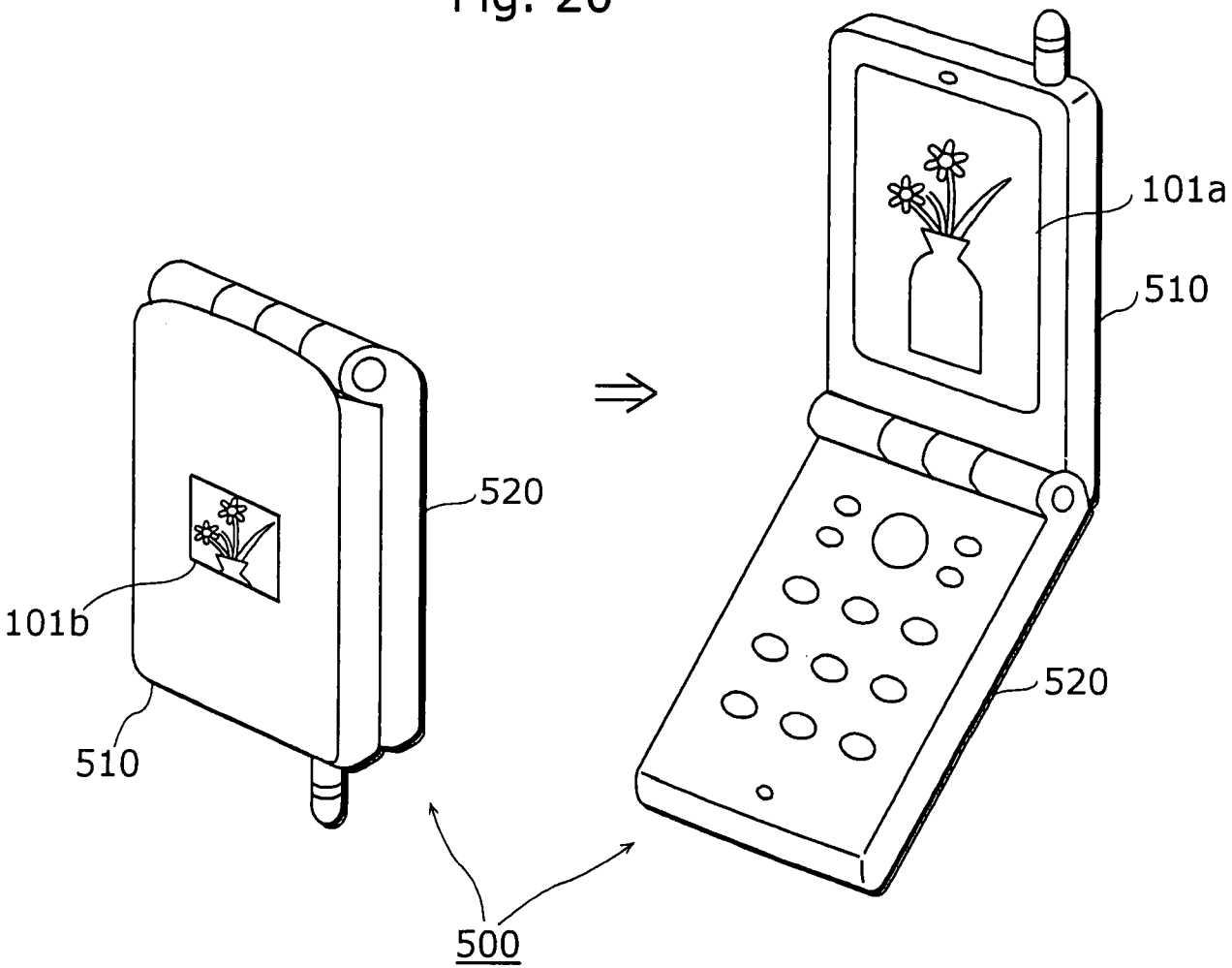
FIG. 20 is an example of an application of the present embodiment to a mobile phone.

FIG. 20 is an example of an application of the image display apparatus 100 equipped with the above-mentioned two LCD screens which are different in size to a mobile phone.

A mobile phone 500 includes an operation unit 520 on which operation buttons and others are arranged for inputting phone numbers and a display unit 510, having two LCD screens 101*a* and 101*b*, which is mounted movably on one edge of the operation unit 520. The larger LCD screen 101*a* is provided on the front side of the display unit 510 and the smaller LCD screen 101*b* is provided on the back side of the display unit 510.

This mobile phone 500 changes its mode into a folding mode and a talk mode by moving the display unit 510. In the folding mode, the display unit 510 and the operation unit 520 overlap each other so as to house the LCD screen 101*a* and the operation buttons, whereas in the talk mode, the LCD screen 101*a* and the operation buttons are exposed so as to allow talks over the phone.

In other words, in the mobile phone 500 equipped with the image display apparatus 100 in the present embodiment, the parameter determination unit 121 selects the larger LCD screen 101*a* so as to display an image thereon when the mobile phone 500 is changed into the talk mode by a user's operation.

When the user changes the mobile phone 500 into the folding mode, the parameter determination unit 121 selects the smaller LCD screen 101*b*, and then the mobile phone 500 switches from the LCD screen 101*a* to the LCD screen 101*b* so as to display the image thereon. In this case, the resource control unit 131 stops the operations of unnecessary resource subunits 610 among a plurality of resource subunits 610 assigned for the talk mode because the size of the LCD screen becomes smaller.

Since the operations of the resource subunits 610 are stopped depending on the mode of the mobile phone 500 as mentioned above, power saving can be achieved.

When the mobile phone 500 is in the folding mode, the operations of the resource subunits 610 unnecessary for image display are not stopped, but they may be used for multiplication for another purpose. As a result, the resource subunits 610 can be used more effectively, and thus the mobile phone 500 can be miniaturized as a whole.

In the above description, an image is displayed on either of the LCD screen 101*a* and the LCD screen 101*b* depending on the mode of the mobile phone 500, but an image may be displayed on both the LCD screen 101*a* and the LCD screen 101*b* respectively in the talk mode and on only the LCD screen 101*b* in the folding mode.

Also, the present embodiment includes a plurality of resource subunits 610, but it may include only one resource subunit 610. In this case, the resource subunit 601 is assigned sequentially to respective units in the image display control unit 103 for its use.

INDUSTRIAL APPLICABILITY

The image display control apparatus according to the present invention can reduce resources substantially and thus reduce its circuit size, and can be applied to a mobile terminal or the like such as a mobile phone and a notebook computer.

What is claimed is:

1. An image display control apparatus that controls light transmittance of liquid crystals of a liquid crystal display screen for displaying an image based on an inputted image signal and controls, according to the light transmittance of the liquid crystals, an amount of light emitted by a backlight unit for illuminating a back of the liquid crystal display screen based on the image signal, the image display control apparatus comprising:

an image state detection unit operable to detect a state of the image based on the image signal;

an image signal transformation unit operable to transform the image signal by performing predetermined signal processing on said image signal based on the state of the image detected by the image state detection unit, and control the light transmittance of the liquid crystals based on the transformed image signal; and a resource control unit operable to:

assign an arithmetic operation resource, which performs an arithmetic operation, to the image state detection unit, instead of to the image signal transformation unit, at a predetermined time when the image state detection unit is to use the arithmetic operation resource; and assign the arithmetic operation resource to the image signal transformation unit, instead of to the image state detection unit, at a predetermined time when the image signal transformation unit is to use the arithmetic operation resource, which is different than the predetermined time when the image state detection unit is to use the arithmetic operation resource, wherein the image state detection unit detects the state of the image using the assigned arithmetic operation resource, and the image signal transformation unit transforms the image signal using the assigned arithmetic operation resource.

2. The image display control apparatus according to claim 1, further comprising a color space transformation unit operable to transform a color component signal including R, G and B component signals in the image signal into a color information signal including at least a brightness signal and a chroma signal, and output said color information signal to the image signal transformation unit, wherein the resource control unit assigns the arithmetic operation resource exclusively to the color space transformation unit at a predetermined timing, and the color space transformation unit transforms the color component signal into the color information signal using the assigned arithmetic operation resource.

3. The image display control apparatus according to claim 2, further comprising a second color space transformation unit operable to transform the color information signal including at least the brightness signal and the chroma signal into the color component signal the R, G and B component signals and output said transformed color component signal, said color information signal being the image signal transformed by the image signal transformation unit, wherein the resource control unit assigns the arithmetic operation resource exclusively to the second color space transformation unit at a predetermined timing, and the second color space transformation unit transforms the color information signal into the color component signal using the assigned arithmetic operation resource.

4. The image display control apparatus according to claim 3, wherein the image signal transformation unit includes:

a brightness transformation unit operable to transform the brightness signal outputted from the color space transformation unit, based on the state of the image detected by the image state detection unit; and a chroma transformation unit operable to transform the chroma signal outputted from the color space transformation unit, based on the state of the image detected by the image state detection unit, the resource control unit assigns the arithmetic operation resource exclusively to the brightness transformation unit at a predetermined timing, and assigns the arithmetic operation resource exclusively to the chroma transformation unit at a predetermined timing, the brightness transformation unit transforms the brightness signal using the assigned arithmetic operation resource, and the chroma transformation unit transforms the chroma signal using the assigned arithmetic operation resource.

5. The image display control apparatus according to claim 4, further comprising a clock signal generation unit operable to generate a clock signal, wherein the resource control unit counts cycles of the clock signal generated by the clock signal generation unit and assigns the arithmetic operation resource according to a count number.

6. The image display control apparatus according to claim 5, wherein each of the image state detection unit, the image signal transformation unit, the color space transformation unit and the second color space transformation unit performs predetermined processing on each pixel in the image signal, and a time interval between inputs of said each pixel in the image signal is longer than the cycle of the clock signal generated by the clock signal generation unit.

7. The image display control apparatus according to claim 6, comprising a plurality of resource units equipped with the arithmetic operation resources respectively, wherein the resource control unit assigns one or plural number of the resource units to each of the image state detection unit, the image signal transformation unit, the color space transformation unit and the second color space transformation unit, said number of the resource units to be assigned being determined according to the processing performed respectively by each of the image state detection unit, the image signal transformation unit, the color space transformation unit and the second color space transformation unit.

8. The image display control apparatus according to claim 7, wherein the arithmetic operation resource is a multiplication unit.

9. The image display control apparatus according to claim 8, wherein the image state detection unit detects the state of the image of each frame based on the image signal, and the image signal transformation unit transforms an image signal of a frame which is to be inputted subsequently to said each frame based on the state of the image of said each frame detected by the image state detection unit.

10. An image display control method executed by an image display control apparatus that controls light transmittance of liquid crystals of a liquid crystal display screen for displaying an image based on an inputted image signal and controls, according to the light transmittance of the liquid crystals, an amount of light emitted by a backlight unit for illuminating a back of the liquid crystal display screen based on the image signal, the image display control method comprising:

an image state detection step of detecting a state of the image based on the image signal;

an image signal transformation step of transforming the image signal by performing predetermined signal processing on said image signal based on the state of the image detected in the image state detection step, and controlling the light transmittance of the liquid crystals based on the transformed image signal; and a resource control step of:

assigning an arithmetic operation resource, which performs an arithmetic operation, to an image state detection unit operable to execute the image state detection step, instead of to an image signal transformation unit operable to execute the image signal transformation step, at a predetermined time when the image state detection unit is to use the arithmetic operation resource; and assigning the arithmetic operation resource to the image signal transformation unit, instead of to the image state detection unit, at a predetermined time when the image signal transformation unit is to use the arithmetic operation resource, which is different than the predetermined time when the image state detection unit is to use the arithmetic operation resource, wherein in the image state detection step, the image state detection unit detects the state of the image using the assigned arithmetic operation resource, and in the image signal transformation step, the image signal transformation unit transforms the image signal using the assigned arithmetic operation resource.

11. The image display control method according to claim 10, wherein in the resource control step, cycles of a clock signal generated by a clock signal generation unit are counted, and the arithmetic operation resource is assigned according to a count number.

12. A program, embodied on a computer-readable medium, executed by an image display control apparatus that controls light transmittance of liquid crystals of a liquid crystal display screen for displaying an image based on an inputted image signal and controls, according to the light transmittance of the liquid crystals, an amount of light emitted by a backlight unit for illuminating a back of the liquid crystal display screen based on the image signal, the program causing the image display control apparatus to execute:

an image state detection step of detecting a state of the image based on the image signal;

an image signal transformation step of transforming the image signal by performing predetermined signal processing on said image signal based on the state of the image detected in the image state detection step, and controlling the light transmittance of the liquid crystals based on the transformed image signal; and a resource control step of:

assigning an arithmetic operation resource, which performs an arithmetic operation, to an image state detection unit operable to execute the image state detection step, instead of to an image signal transformation unit operable to execute the image signal transformation step, at a predetermined time when the image state detection unit is to use the arithmetic operation resource; and assigning the arithmetic operation resource to the image signal transformation unit, instead of to the image state detection unit, at a predetermined time when the image signal transformation unit is to use the arithmetic operation resource, which is different than the predetermined time when the image state detection unit is to use the arithmetic operation resource, wherein in the image state detection step, the image state detection unit detects the state of the image using the assigned arithmetic operation resource, and in the image signal transformation step, the image signal transformation unit transforms the image signal using the assigned arithmetic operation resource.

13. An image display apparatus comprising:

a liquid crystal display screen operable to display an image;

a backlight unit operable to illuminate a back of the liquid crystal display screen;

an image display control apparatus that controls light transmittance of liquid crystals of the liquid crystal display screen based on an inputted image signal and controls, according to the light transmittance of the liquid crystals, an amount of light emitted by the backlight unit based on the image signal, wherein the image display control apparatus includes:

an image state detection unit operable to detect a state of the image based on the image signal;

an image signal transformation unit operable to transform the image signal by performing predetermined signal processing on said image signal based on the state of the image detected by the image state detection unit, and control the light transmittance of the liquid crystals based on the transformed image signal; and a resource control unit operable to:

assign an arithmetic operation resource, which performs an arithmetic operation, to the image state detection unit, instead of to the image signal transformation unit, at a predetermined time when the image state detection unit is to use the arithmetic operation resource; and assign the arithmetic operation resource to the image signal transformation unit, instead of to the image state detection unit, at a predetermined time when the image signal transformation unit is to use the arithmetic operation resource, which is different than the predetermined time when the image state detection unit is to use the arithmetic operation resource, wherein the image state detection unit detects the state of the image using the assigned arithmetic operation resource, and the image signal transformation unit transforms the image signal using the assigned arithmetic operation resource.

* * * * *